US009060575B2

(12) United States Patent
Chien et al.

(10) Patent No.: US 9,060,575 B2
(45) Date of Patent: Jun. 23, 2015

(54) INTEGRATED ILLUMINATION PART AND LEAD FRAME OF UMBRELLA

(71) Applicant: LongWide Technology Inc., Nantou County (TW)

(72) Inventors: Huan-Jan Chien, Hsinchu County (TW); Tsung-Hong Tsai, Nantou County (TW)

(73) Assignee: LONGWIDE TECHNOLOGY INC., Nantou County (TW)

( * ) Notice: Subject to any disclaimer, the term of this patent is extended or adjusted under 35 U.S.C. 154(b) by 340 days.

(21) Appl. No.: 13/682,374

(22) Filed: Nov. 20, 2012

(65) Prior Publication Data

US 2013/0128496 A1 May 23, 2013

(30) Foreign Application Priority Data

Nov. 21, 2011 (TW) ..... 100142476 A

(51) Int. Cl.

| | |
|---|---|
| ***A45B 25/02*** | (2006.01) |
| ***F21V 19/00*** | (2006.01) |
| ***A45B 3/04*** | (2006.01) |
| ***A45B 23/00*** | (2006.01) |
| ***A45B 25/00*** | (2006.01) |

(52) U.S. Cl.

CPC ..... *A45B 25/02* (2013.01); *F21V 19/00* (2013.01); *A45B 3/04* (2013.01); *A45B 23/00* (2013.01); *A45B 25/00* (2013.01); *A45B 2023/0006* (2013.01); *A45B 2200/1018* (2013.01)

(58) Field of Classification Search

CPC ... A45B 25/02; A45B 3/04; A45B 2200/1018

USPC ..... 362/102, 109

See application file for complete search history.

(56) References Cited

U.S. PATENT DOCUMENTS

| | | | | |
|---|---|---|---|---|
| 4,031,381 | A * | 6/1977 | Carver | 362/102 |
| 6,299,337 | B1 | 10/2001 | Bachl | |
| 2010/0254117 | A1 | 10/2010 | Hsu | |

FOREIGN PATENT DOCUMENTS

| | | | |
|---|---|---|---|
| CN | 201059434 | Y | 5/2008 |
| CN | 101871587 | A | 10/2010 |
| TW | M282098 | | 12/2005 |
| TW | M390637 | | 10/2010 |
| TW | 099113164 | | 11/2011 |

* cited by examiner

*Primary Examiner* — David V Bruce

(74) *Attorney, Agent, or Firm* — Ming Chow; Sinorica, LLC

(57) ABSTRACT

The manufacturing method of the integrated illumination part used in the present invention is to install annular lead frame with luminous LED chip on main part body of the umbrella, then package into one unity with transparent material such as plastic or silica gel, for example, slip ring, installation seat, handle and other parts can be used to produce the part. The purpose of the present aims at innovating the structure of annular lead frame made of sheet metal whereby to increase the mass production of integrated illumination part and diversity of light source, and fully to utilize high heat dissipation capacity of umbrella parts. It includes single-layer and multilayer structure according to the functional demand of LED chip; the manufacturing method of annular lead frame is first to produce LED chip and lead frame into LED lead frame, then bend it into annular with jig according to the appearance of main part body and fix power pin into annular structure with fastener.

7 Claims, 24 Drawing Sheets

INTEGRATED ILLUMINATION PART AND LEAD FRAME OF UMBRELLA

CROSS-REFERENCE

The current application claims a foreign priority to the patent application of Taiwan No. 100142476 filed on Nov. 21, 2011.

SUMMARY OF THE INVENTION

The manufacturing method of the integrated illumination part used in the present invention is to package annular lead frame with luminous LED chip and umbrella part into one unity with transparent material such as plastic or silica gel, for example, slip ring, installation seat, handle, and other parts can be used to produce the part. The structure of annular lead frame is made of sheet metal. The structure can be a single-layer or multilayer structure according to the functional demand of LED chip. The current invention can increase the mass production of integrated illumination part and diversity of light source, and fully utilize the high heat dissipation capacity of umbrella part. RGB colors of color LED chip can change in gradation to enable the umbrella to realize illumination and warning effects as well as aesthetic decoration effect like lantern when it is used at night.

PRIOR ART

Luminous umbrella refers to the umbrella which is installed with illumination device. Its function is increasing the safety of the user when walking at night, especially for the safety of the pedestrian in the raining night, because the pedestrian cannot see the pot hole on the road and drivers do not have good vision, the safety of pedestrian will be harmed. When umbrella can increase illumination and warning functions, the aforementioned problems can be substantially improved. Therefore, the solutions in hundreds of patent papers that have been published since 1930 have used the additional device to provide the functions of luminous umbrella, and the concept of integrated illumination part was initially proposed in 2010, the key point is to conduct parallel connection or series connection of LED illumination element with flexible wire and produce into luminous flexible part, then package umbrella part and luminous flexible part together with transparent material. As far as luminous flexible part, the structure was produced as strip-shaped or banded light in LED prior art or was produced by installing LED chip on flexible PCB. In some of solutions, it can be pasted on the part surface, and some solutions include heat dissipating function. Relevant solutions are explained as follows:

Prima Facie Case 1:

Taiwan Patent Application No. 099113164 entitled "Improvement Structure of Luminous Umbrella" filed in 2010 proposes new solution in relation to the innovation of integrated illumination part, packaged LED luminous element, wire and the umbrella's part pedestal together. The LED flexible illumination system pastes the packaged LED luminous element on main part body with the wire in series connection or parallel connection, and conducts overall package with transparent materials from outside to enable umbrella part itself to have illumination function, which fully utilizes high heat dissipation capacity of main part body, and can really exert heat dissipating function of high brightness LED. However, such is unable to meet the demand of the functions of RGB color LED.

Prima Facie Case 2:

US Patent Application No. 2010254117A1 entitled "Light emitting device having LED and flexible electrical wiring covered and plastic material" filed in 2010 uses flexible flat wire having plastic covered as electrical wire of LED. The practice is to cut open part of wire housing at proper distance to enable the properly packaged LED electrode to be directly connected with the exposed metal wire and accomplish the connection with power, and make insulating treatment again to enable flexible wire to become strip-shaped flexible luminous body. The circuit can apply to series connection or parallel connection or composite circuit, and meet the demand of RGB color LED. This Prima Facie Case is possible to be used for integrated illumination part, but the explanation or embodiment for further packaging the umbrella part into one unity is not available.

Prima Facie Case 3:

CN Application No. 2010434Y entitled "improved LED flexible lighting product structure" filed in 2008 is a kind of improved LED rope light structure, one strip of light core is installed inside transparent plastic housing. Light core has one through hole along the pipeline to contain wire, and longitudinal through hole is set up in light core to install LED. And bend 2 pins of LED to relatively linear shape, use wire to weld series LED into strip-shaped luminous body as luminaire. The light core and LED in this Prima Facie Case are possible to be used in integrated illumination part, but the explanation or embodiment for further packaging the umbrella part into one unity is not available.

Prima Facie Case 4:

Taiwan Utility Patent No. M282098 relates to "Rope form LED decorative light" filed in 2005. In this patent, the flexible FPC is installed with plural LED chip and circuit, and packaged into rope form with flexible transparent materials to accomplish decoration function. This patent is possible to be used in integrated illumination part, but the explanation or embodiment for further packaging the umbrella part into one unity is not available.

Prima Facie Case 5:

U.S. Pat. No. 6,299,337B1 relates to "Flexible multiple led module, in particular for a luminaire housing of a motor vehicle" filed in 2001. The hard PCB is installed with LED chip, and connected with flexible PCB printed with connection circuit to enable LED luminous module to be installed according to the shape of motor light. Heat dissipation of LED luminous element must penetrate hard PCB. This Prima Facie Case is possible to be used in integrated illumination part but the explanation or embodiment for further packaging the umbrella part into one unity is not available.

Prima Facie Case 6:

CN Patent Application No. 101871587A relates to "Packaging method of LED (light-emitting diode) flexible lamp strip" filed in 2010. It is a kind of LED flexible light bar packaging method; the mounted LED on the surface is welded on one strip-shaped flexible PCB, and placed into flexible transparent tube for cementing and packaged, which is used in flexible luminaire device. The flexible PCB in this Prima Facie Case is possible to be used in integrated illumination part but the explanation or embodiment for further packaging the umbrella part into one unity is not available.

Prima Facie Case 7:

Taiwan Utility Patent No. M390637 relates to "High Power LED flexible PCB" filed in 2010. The flexible PCB is installed with through hole, which is used to install LED and enable the back of LED to be directly pasted on the surface of articles that can dissipate heat, and used in flexible luminaire device. This Prima Facie Case is possible to be used in integrated illumination part but the explanation or embodiment for further packaging the umbrella part into one unity is not available.

Among the above solutions, only Prima Facie Case 1 proposed the practice of integrated illumination part, the rest Prima Facie Cases have neither integrated illumination part nor relevant application cases in luminous umbrella, but the flexible illumination part is prior art, which is settled and explained as follows: Prima Facie Case 2 and Prima Facie Case 3 use flexible wire to connect LED illumination part, and Prima Facie Case 2 can also meet the demand of RGB color LED, but it lacks fastener and electric pin structure required for annular lead frame, and heat dissipating program required for high brightness LED; Prima Facie Case 4, Prima Facie Case 5, Prima Facie Case 6 and Prima Facie Case 7 use flexible PCB to install or use flexible PCB to connect LED illumination part and have flexible function, but they lack fastener and electric pin structure required for annular lead frame. Prima Facie Case 4 can meet the demand of RGB color LED, only Prima Facie Case 7 has heat dissipating program required for high brightness LED; The above Prima Facie Cases of prior art are unable to fully meet the demand of integrated illumination part of the umbrella. The following problems must be solved:

Problem 1. The production of luminous flexible part must be more easily applied in integrated illumination parts such as fastener and electric pin, and more conveniently pasted on umbrella's main part body and packaged for umbrella assembly and mass production; and must be able to reduce large-scale mass production requirements of luminous flexible part itself and low cost requirements. If the flexible PCB is installed with LED chip, mass production of certain scale can ensure low cost.

Problem 2. LED chip of luminous flexible part should be really fixed, and large main part body contact surface should be available for dissipating heat and reducing heat resistance.

Problem 3. Various LED chips must be used, including the packaged LED and bare chip LED, and can be applicable to monochromatic chip and RGB color chip, and even meet the demand of parallel, series and mixed series and parallel circuit.

The present invention performs research and development in accordance with the aforementioned three problems to enable the structure of innovative annular lead frame to fully enhance the function of integrated illumination part.

BRIEF DESCRIPTION OF THE DRAWINGS

FIG. 5(*b*) illustrates structure of charge tape of annular lead frame of monochromatic packaged LED series circuit used in the third embodiment of the present invention.

FIG. 5(*c*) illustrates structure of annular lead frame of monochromatic packaged LED parallel circuit used in the third embodiment of the present invention.

FIG. 6(*b*) illustrates structure of charge tape of annular lead frame of multicolor packaged LED series circuit used in the fourth embodiment of the present invention.

FIG. 6(*c*) illustrates structure of monolithic charge tape of annular lead frame of multicolor packaged LED series circuit used in the fourth embodiment of the present invention.

FIG. 6(*d*) illustrates structure of annular lead frame of multicolor packaged LED parallel circuit used in the fourth embodiment of the present invention.

FIG. 7(*b*) illustrates multilayer structure of annular lead frame of multicolor SMD LED series circuit used in the fifth embodiment of the present invention.

FIG. 7(*c*) illustrates structure of annular lead frame of multicolor SMD LED parallel circuit used in the fifth embodiment of the present invention.

FIG. 7(*d*) illustrates multilayer structure of annular lead frame of multicolor SMD LED parallel circuit used in the fifth embodiment of the present invention.

FIG. 7(*e*) illustrates layered structure of LED lead frame of monochromatic SMD LED series circuit used in the fifth embodiment of the present invention.

FIG. 7(*f*) illustrates layered structure of LED lead frame of monochromatic SMD LED parallel circuit used in the fifth embodiment of the present invention.

FIG. 7(*g*) illustrates layered structure of LED lead frame of monochromatic SMD LED and mixed series and parallel circuit used in the fifth embodiment of the present invention.

FIG. 8(*b*) illustrates single-layer structure of annular lead frame of coplanar electrode monochromatic bare chip LED series circuit used in the sixth embodiment of the present invention.

FIG. 8(*c*) illustrates structure of annular lead frame of coplanar electrode monochromatic bare chip LED parallel circuit used in the sixth embodiment of the present invention.

FIG. 8(*d*) illustrates structure of LED lead frame of coplanar electrode monochromatic bare chip LED parallel circuit used in the sixth embodiment of the present invention.

FIG. 8(*e*) illustrates structure of series and parallel installation seat chip package of coplanar electrode monochromatic bare chip LED used in the sixth embodiment of the present invention.

FIG. 9(*b*) illustrates multilayer structure of annular lead frame of monochromatic bare chip LED series circuit of upper and lower electrodes used in the seventh embodiment of the present invention.

FIG. 9(*c*) illustrates structure of annular lead frame of monochromatic bare chip LED parallel circuit of upper and lower electrodes used in the seventh embodiment of the present invention.

FIG. 9(*d*) illustrates multilayer structure of annular lead frame of monochromatic bare chip LED parallel circuit of upper and lower electrodes used in the seventh embodiment of the present invention.

FIG. 10(*b*) illustrates multilayer structure of annular lead frame of coplanar electrode multicolor bare chip LED series circuit used in the eighth embodiment of the present invention.

FIG. 10(*c*) illustrates structure of annular lead frame of coplanar electrode multicolor bare chip LED parallel circuit used in the eighth embodiment of the present invention.

FIG. 10(*d*) illustrates multilayer structure of annular lead frame of coplanar electrode multicolor bare chip LED parallel circuit used in the eighth embodiment of the present invention.

FIG. 10(*e*) illustrates structure of installation seat package of coplanar electrode multicolor bare chip LED series circuit used in the eighth embodiment of the present invention.

FIG. 10(*f*) illustrates structure of installation seat of coplanar electrode multicolor bare chip LED parallel circuit used in the eighth embodiment of the present invention.

FIG. 11(*b*) illustrates multilayer structure of annular lead frame of multicolor bare chip LED parallel circuit of upper and lower electrodes used in the ninth embodiment of the present invention.

FIG. 11(*c*) illustrates structure of annular lead frame of multicolor bare chip LED series circuit of upper and lower electrodes used in the ninth embodiment of the present invention.

FIG. 11(*d*) illustrates multilayer structure of annular lead frame of multicolor bare chip LED series circuit of upper and lower electrodes in the ninth embodiment of the present invention.

FIG. 11(*e*) illustrates structure of installation seat package of multicolor bare chip LED series circuit of upper and lower electrodes used in the ninth embodiment of the present invention.

FIG. 11(*f*) illustrates structure of installation seat package of multicolor bare chip LED parallel circuit of upper and lower electrodes used in the ninth embodiment of the present invention.

FIG. 12(*b*) illustrates fitting between cone top annular surface of fixed ring and bearing disc used in the present invention.

DETAILED DESCRIPTION OF THE INVENTION

Figure 1:
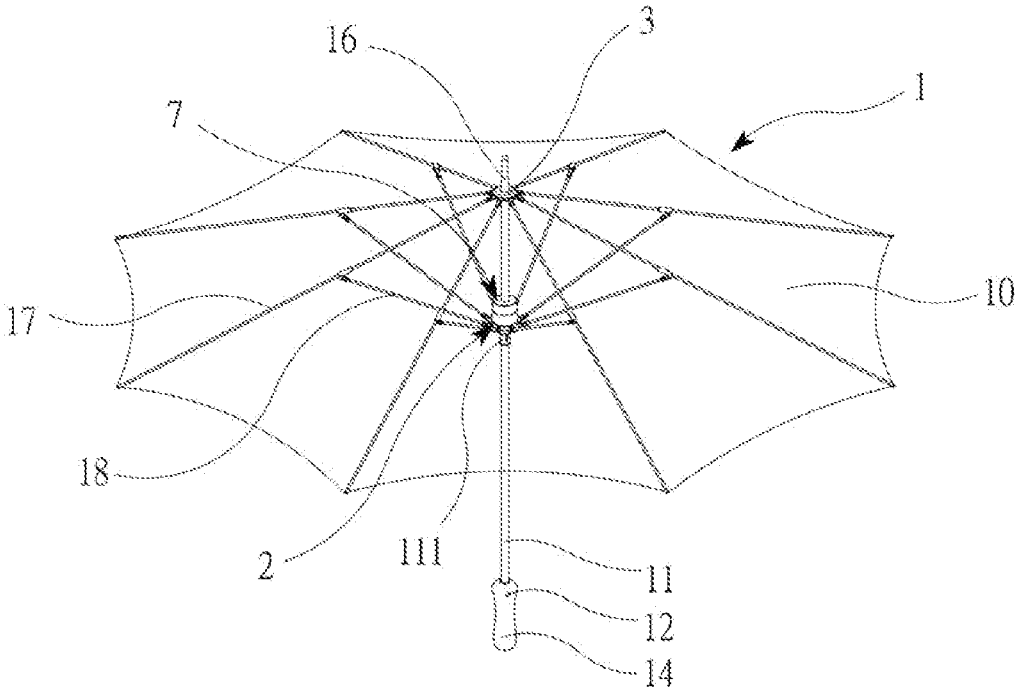
FIG. 1 illustrates structure of the first kind of integrated illumination parts applied in luminous umbrella used in the embodiment of the present invention.

The manufacturing method of the integrated illumination part used in the present invention is to install lead frame with luminous LED chip on main part body of the umbrella, then package into one unity with transparent material such as plastic or silica gel, for example, slip ring, installation seat, handle and other parts can be used to produce the part.

The main advantage of the present invention is the structure of annular lead frame is made of sheet metal and can increase the mass production of integrated illumination part and diversity of light source, and fully utilize high heat dissipation capacity of umbrella part. It can be a single-layer or multilayer structure according to the functional demand of LED chip.

LED chip group referred in the present invention contains packaged LED, SMD LED and bare chip LED. Unless specially indicated, the above chips will be generally called LED chips. The quantity of packaged LED and internal packaged bare chips of SMD LED can be more than one chip, containing protective Zener diode. The arrangement among chips can be parallel connection, series connection, or mixing of series and parallel connection.

Electrode contact of packaged LED includes two-contact or plural contact. Those with exposed electrode pins can be divided into two-row upright type or horizontal type.

SMD LED belongs to surface mounted package. Those with electrode pins on the underside of chip package and not stretched out and exposed, such as PLCC/SMD/SMT, are called chip LED.

Bare chip LED belongs to bare chips, which can be further divided into coplanar electrode, top and bottom plane electrode and flip chip electrode according to the position of electrode contact.

The illumination colors of LED chip can be monochromatic, multicolor, or white light, in which white light can be got from more than three pieces of multicolor LED chips or got by adding fluorescent powder on LED chip.

The manufacturing sequence of integrated illumination part is first to manufacture single-layer lead frame, then superimpose into multilayer lead frame, and then install LED on installation seat and form LED lead frame. Finally, bend the wire of LED lead frame into ring shape according to the appearance of main part body; fix the power pin with fastener to become one annular lead frame; install and paste the installation seat on main part body, then package as one integrated illumination part with transparent materials. The parts related to lead frame contain single-layer lead frame, multilayer lead frame, LED lead frame and annular lead frame, which are explained as follows:

Single-layer lead frame can be further divided into monolithic single-layer lead frame or multidisc parallel single-layer lead frame. Monolithic single-layer lead frame is the most basic element that constitutes lead frame. When only monolithic single-layer lead frame is used in circuit, it can be used in series circuit of monochromatic or white light LED chip. Multidisc parallel single-layer lead frame is consisted of multidisc monolithic single-layer lead frame in parallel or series arrangement, which can be used in parallel circuit of monochromatic or white light LED chip or series or parallel circuit of multicolor packaged LED, or mixed series and parallel circuit.

Monolithic single-layer lead frame has plural wires, insulating layer, more than one installation seats connected with wire, one power pin on each end respectively, or power pin on one end and common contact on the other end, or power pin on one end only, or power pin on neither ends. Conductive sheet metal is used to produce one arc strip-shaped disc.

The appearance of installation seat of monolithic single-layer lead frame can meet the dimension of LED chip. If the installation seat does not have installation seat wire, the electrode contact is wire end. The end of two adjacent wire constitute one group of high and low potential electrode contact, or the wire of installation seat is equipped with insulating joint to get two sections of installation seat wire, and one group of high and low potential contact respectively exist above. This lead frame consists of several sections of conductive metals, the same section of metal wire has the same potential, and then such monolithic single-layer lead frame is serial lead frame.

If the installation seat wire of monolithic single-layer lead frame becomes integrated wire, appearing strip, annular or rectangular shape, and having only one group of high or low potential electrode contact, such monolithic single-layer lead frame belongs to continuous lead frame.

The monolithic serial lead frame can constitute one simple series circuit; if two-disc parallel continuous lead frames respectively have high and low potential, they can constitute one simple parallel circuit.

Multidisc parallel single-layer lead frame refers to serial lead frame or continuous lead frame with more than two discs or constituted by combining both of them in parallel position, and both constituting ends have one single-layer lead frame of circuit loop of power pin respectively. The insulating joints exist among discs for isolation, which are applicable to mixed series and parallel circuit to meet the demand of circuit used in LED chip.

Multilayer lead frame is superimposed with several single-layer lead frames into multilayer structure according to the demand of LED chip, containing mixed multilayer structure of serial lead frame and continuous lead frame, even sometimes containing more than one-stacked bearing discs according to the demand, and multilayer-superimposed lead frame can apply to monochromatic or color LED chip.

LED lead frame shall install LED chip on LED installation seat of single-layer lead frame or multilayer lead frame and package.

Annular lead frame shall bend the wire of LED lead frame into ring shape according to the appearance of main part body and fix power pin with fastener.

Annular lead frame can meet the installation of LED chip and can the circuit demand of parallel connection, series connection and mixed series and parallel connection, and multicolor gradation change will enable the umbrella to get illumination and warning effects as well as aesthetic decoration effect like lantern when it is used at night.

LED lead frame contains one-layer or multilayer single-layer lead frame, and the process is explain as follows:

In single-layer lead frame, conductive sheet metal is used to produce one arc strip-shaped disc. The arc length should be in conformity with the external circumference size of umbrella part; the section thickness of main body of strip-shaped conductive metal is from more than 0.05 mm to less than 2 mm, and section width is from more than 1 mm to less than 10 mm; conductive metal contains ferrous metal, non-ferrous metal and copper foil FPC.

Single-layer lead frame has plural wires, insulating layer, more than one installation seats connected with wire, one power pin on each end respectively, or power pin on one end and common contact on the other end, or power pin in on one end only, or power pin on neither ends. LED installation seat is consisted of an installation seat wire that is equipped with high or low potential electrode contact. If it has high and low potential electrode at the same time, high and low potential electrode contacts will be isolated with insulating joints. According to the demand, monolithic conductive frame can be used to produce more than one multidisc parallel single-layer lead frames containing isolated by insulating joints to constitute one mixed series and parallel electric loop unit.

For the convenience of production, the common practice is to properly arrange the patterns of single-layer lead frame on banded metal plate, increase the plural required connecting parts with different shapes to enable single-layer lead frames to be connected as cellular charge tape structure, and processed into cellular charge tape with location hold for superimposing multilayer charge tapes and installing LED chip. It is hereinafter referred to as charge tape, according to different demand of LED chip, and the demand of circuit under parallel connection, series connection and mixed series and parallel connection. The conductive sheet metal structure of each piece of charge tape can be designed in different ways according to the demand.

According to the demand, lead frame shall superimpose the charge tapes of multilayer, then install LED chip and superimpose chip bearing discs at underside of installation seat as required. Each layer of charge tape has heat conduction insulating layer, such as insulating varnish, to prevent short circuit. The multilayer charge tape will have excellent structural rigidity after being bonded with insulating heat conduction cement, suitable for installation of LED chip and further processing.

After the superimposed charge tapes are installed on the jig, LED chip can be installed on the installation seat. Paste conductive adhesive on each electrode contact and connect each electrode contact with gold wire. For example, at first, paste and fix bare chip in bearing disc, then break over the circuit with gold wire, package and fix with transparent package cement. If necessary, add in fluorescent powder, conduct heating and solid jointing to enable LED chip to be steadily fixed. At this time, the power pin of charge tape can be processed into form to get the required shape and flexing angle. In the meanwhile, each part can be cut into individual parts, the single-layer lead frame or multilayer lead frame can be called LED lead frame, and the both ends have power pins.

It can be bent into ring shape with jig by means of the plastic deformation feature of conductive metal. The power pins on both ends of LED lead frame can be fixed with fastener to become one annular lead frame.

At this time, if the LED installation seat of annular lead frame is pasted with heat conduction cement and installed on main part body, fastener broadside can be pasted on the fixed side of main part body to ensure correct position of power pin. Then the umbrella part is placed in the die and packaged into integrated structure with transparent materials to finish the production of integrated illumination part of the umbrella.

The annular lead frame structure of integrated illumination part used in the present invention can substantially improve the mass production process, because large-area underside of installation seat is directly pasted on main part body to substantially increase heat conduction capacity, and conductive metal itself has excellent heat dissipation capacity too to help LED chip dissipate heat and reduce temperature.

The annular lead frame of integrated illumination part used in the present invention can meet the demand of monochromatic and color LED, enable the light to show color gradation change via controller and the umbrella to own illumination and warning effects like lantern when it is used in night, and the dazzling light color changes can get the aesthetic decorative effect.

The solutions proposed in the present invention can improve the functions of the umbrella's integrated illumination part and accomplish the following effects:

Effect 1. The mass production of lead frame charge tape made of conductive metal charge tape will be much higher than that of flexible wire program in Prima Facie Case, which can also avoid the higher requirements of mass production of flexible PCB, keep the acceptable cost to popularize the application of LED chip, meet the demand of monochromatic, multicolor and multi-bare chip packaged LED chips, and even meet the demand of parallel connection, series connection and the mixed series and parallel connection circuit.

Effect 2. The bottom plane of LED chip installation seat has large area for pasting to the surface of main part body, thus increasing heat dissipating efficiency.

Effect 3. If annular lead frame is pasted on the umbrella's main part body, it will be convenient to package with transparent materials and maintain correct position of power pin, and convenient for umbrella assembly and mass production.

Implementation Method

In order to explain the functional improvement of integrated illumination part emphasized in the present invention, the following embodiments shall further reveal but it shall not be limited to the following embodiments. For the sake of clear explanation, the thickness of insulating layer in the descriptions of the following embodiments is not the actual thickness, which is used for explanation only. All parts can meet the necessary requirements for electric insulation and electric safety.

Embodiment 1 is the first kind of integrated illumination part that is applied in luminous umbrella used in the present invention.

Please refer to FIG. 1, umbrella 1 contains flexible canopy 10, shaft 11, plate spring 111, pressing switch 12, handle 14, top column 16, rib members 17, linkages 18, slip ring assembly 2, fixed collar 3, power socket 7. Slip ring assembly 2 is an integrated illumination part in this embodiment. In this embodiment, handle 14, top column 16 and fixed collar 3 were not made into integrated illumination parts but can be processed into integrated illumination parts with the method specified in the present invention. In the umbrella structure, shaft 11 is installed with plate spring 111, hollow part of shaft 11 is installed with electrical wire 13 (not shown in the figure), end of shaft 11 is equipped with top column 16, lower part of shaft 11 is equipped with handle 14, upper part is equipped with pressing switch 12, the inside has battery (not shown in the figure) and drive circuit (not shown in the figure. The upper part of shaft 11 is installed with slip ring assembly 2, power socket 7 and fixed collar 3. The rib members 17 and the linkages 18 are mutually connected with pivot, and respectively fixed on collar 3 and slip ring assembly 2 with pivot. The flexible canopy 10 fixed on rib members 17. The middle of flexible canopy 10 has a through hole. The shaft 11 can pass through top annular surface of fixed collar 3, clamped and fixed by the lower border of top column 16. Upward and downward sliding of slip ring assembly 2 on shaft 11 can open and close the umbrella, when the umbrella is opened, slip ring assembly 2 can be firmly humped by plate spring 111 and the umbrella can be kept open, thus accomplishing the illumination function of the umbrella.

Shaft 11 is equipped with through hole to let electrical wire 13 pass through and connect power socket 7. Power pin 576 (as per FIG. 3) on the slip ring assembly 2 and power socket 7 are mutually constituted one group of circuit movable switches. When joint circuit socket 7 of power pin 576 (as per FIG. 3) is closed and pressing switch 12 is closed, the circuit will be broken over, LED chip group 4 (as per FIG. 3) will illuminate the inner face of flexible canopy 10. The power socket 7 will enable power pin 576 (as per FIG. 3) to maintain insulated and dry to avoid from short circuit, and can input proper voltage via power pin 576 (as per FIG. 3) according to the demand of LED chip group 4 (as per FIG. 3). When the umbrella needs to be used in the fixed position for a long time, battery power can be changed into external power.

Figure 3:
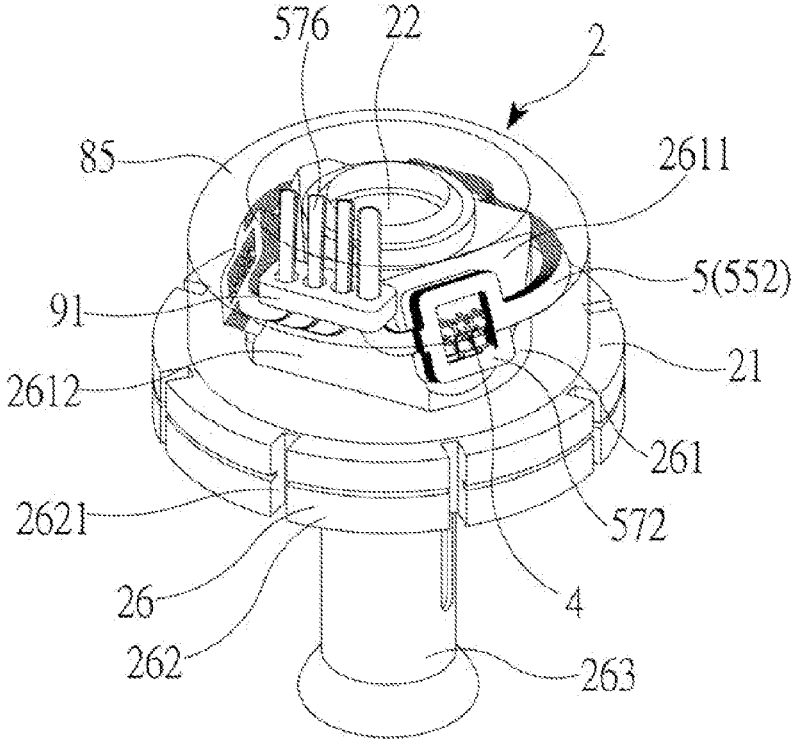
FIG. 3 illustrates structure of slip ring composite structure used in the first embodiment of the present invention.

Please refer to FIG. 3, composite structure diagram of movable collar used in Embodiment 1 of the present invention. Movable collar assembly 2 contains main movable collar body 21, annular lead frame 5 and transparent package 85. Shaft 11 (as per FIG. 1) passing through the central hole 22 of movable collar assembly 2.

Exterior annular surface 26 of main movable collar body 21 contains top annular surface 261, middle annular surface 262 and bottom annular surface 263. Middle annular surface 262 is equipped with plural fixed slots 2621 and fixed linkages 18 with pivot, which can be used as LED heat dissipating surface of chip group 4.

Top annular surface 261 is used to install annular lead frame 5, which is equipped with faying surface 2611 and fastener's fixed surface 2612 to fit underside of installation seat 572 and fix wire fastener 91. The manufacturing method of annular lead frame 5 is first bend LED lead frame into form, fix power pins 576 on two ends with fastener 91 to get one annular lead frame 5, fix on main movable collar body 21, use transparent materials to complete transparent package 85. The appearance of transparent package 85 can be adjusted according to the required light type. The heat of LED chip group 4 on slip ring assembly 2 will be transmitted to atmosphere from the surface of plural fixed slots 262, therefore, it can reduce the temperature of LED chip group 4 and input proper voltage via power pin 576 according to the demand of LED chip group 4.

Embodiment 2 is the second kind of integrated illumination part that is applied in luminous umbrella used in the present invention.

Figure 2:
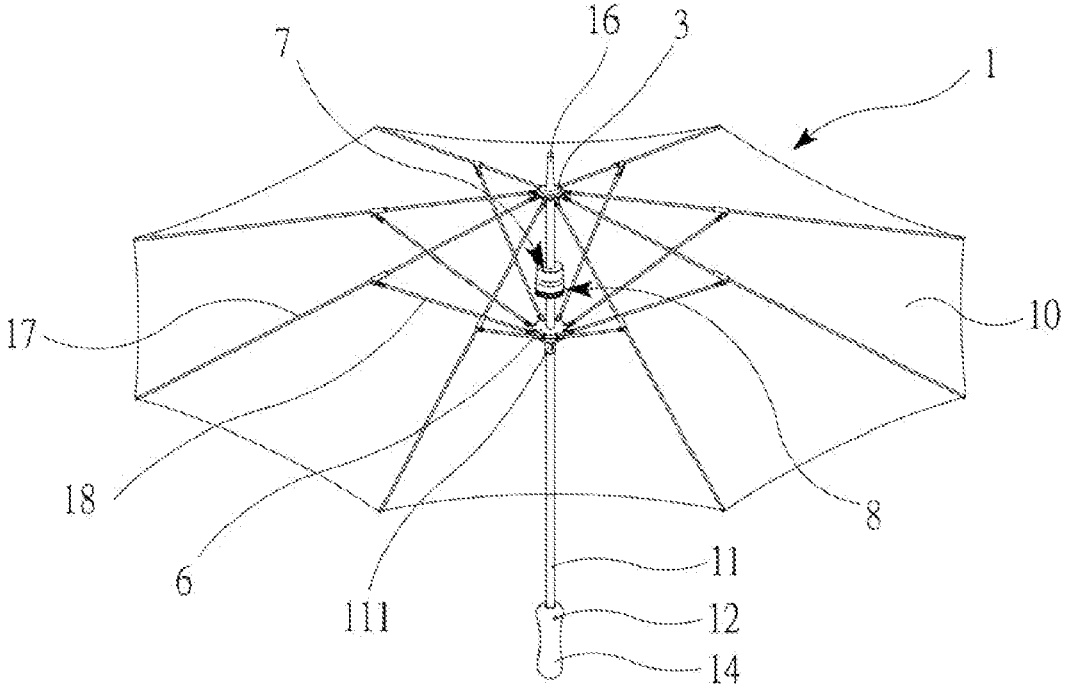
FIG. 2 illustrates structure of the second kind of integrated illumination parts applied in luminous umbrella used in the second embodiment of the present invention.

Please refer to FIG. 2, the umbrella 1 contains flexible canopy 10, shaft 11, plate spring 111, pressing switch 12, handle 14, top column 16, rib members 17, linkages 18, slip ring 6, fixed ring assembly 8, fixed collar 3, power socket 7. The ring assembly 8 in this embodiment is an integrated illumination part. In this embodiment, handle 14, top column 16 and fixed collar 3 were not made into integrated illumination parts but can be processed into integrated illumination parts with the method specified in the present invention. The aforementioned umbrella structure is that shaft 11 is installed with plate spring 111. Hollow part of shaft 11 is installed with electrical wire 13 (not shown in the figure). The end of shaft 11 is equipped with top column 16. The lower part of shaft 11 is equipped with handle 14, upper part is equipped with pressing switch 12, and the inside has battery (not shown in the figure) and drive circuit (not shown in the figure). The upper part of shaft 11 is installed with slip ring 6, fixed ring assembly 8, power socket 7 and fixed collar 3. Rib members 17 and linkages 18 are mutually connected with pivot, and respectively fixed on collar 3 and slip ring 6 by pivot. Flexible canopy 10 is fixed on rib members 17. The middle of flexible canopy 10 has a through hole that the shaft 11 can pass through the top annular surface of fixed collar 3, clamped and fixed by the lower border of top column 16. Upward and downward sliding of slip ring 6 along shaft 11 can open and close the umbrella, when the umbrella is opened, slip ring 6 can be firmly humped by plate spring 111 and the umbrella can be kept open, thus accomplishing the illumination function of the umbrella.

Shaft 11 is equipped with through hole to let electrical wire 13 pass through and connect power socket 7. Power pin 576 (as per FIG. 4) on slip ring assembly 8 and power socket 7 are closed. When pressing switch 12 is closed, the circuit will be broken over, LED chip group 4 (as per FIG. 4) will illuminate the inner face of flexible canopy 10. The power socket 7 will enable power pin 576 (as per FIG. 4) maintain insulated and dry to avoid from short circuit, and can input proper voltage via power pin 576 (as per FIG. 4) according to the demand of LED chip group 4 (as per FIG. 4). When the umbrella needs to be used in the fixed position for a long time, battery power can be changed into external power.

Figure 4:
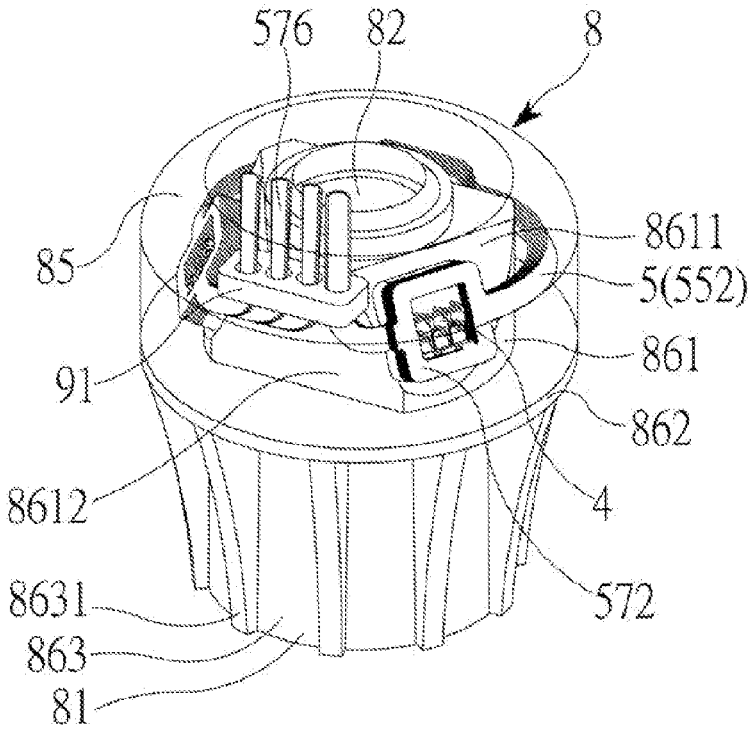
FIG. 4 illustrates structure of fixed ring composite structure used in the second embodiment of the present invention.

Please refer to FIG. 4, composite structure diagram of fixed ring used in Embodiment 2 of the present invention. Fixed ring assembly 8 contains main fixed ring body 81, annular lead frame 5 and transparent package 85. Central hole for shaft 82 of fixed ring assembly 8 has pass through of shaft 11 (as per FIG. 2), which is fixed with fixed pin (as per FIG. 2).

Exterior annular surface 86 of main fixed ring body 81 contains top annular surface 861, middle annular surface 862 and bottom annular surface 863. Bottom annular surface 863 is equipped with plural heat dissipating fin 8631, which can be used as heat dissipating surface of LED chip group 4.

Top annular surface 861 can be installed on annular lead frame 5, which is equipped with faying surface 8611 and fastener's fixed surface 8612 to fit underside of installation seat 572 and fix wire fastener 91. The manufacturing method of annular lead frame 5 is first bend LED lead frame into form, fix power pins 576 on two ends with fastener 91 to get one annular lead frame 5, after fixing on main movable collar body 81, use transparent materials to complete transparent package 85. The appearance of transparent package 85 can be adjusted according to the required light type. The heat of LED chip group 4 on slip ring assembly 8 will be transmitted to atmosphere from the surface of plural heat dissipating fin 8631, therefore, it can reduce the temperature of LED chip group 4 and input proper voltage via power pin 576 according to the demand of LED chip group 4.

Figure 12A:
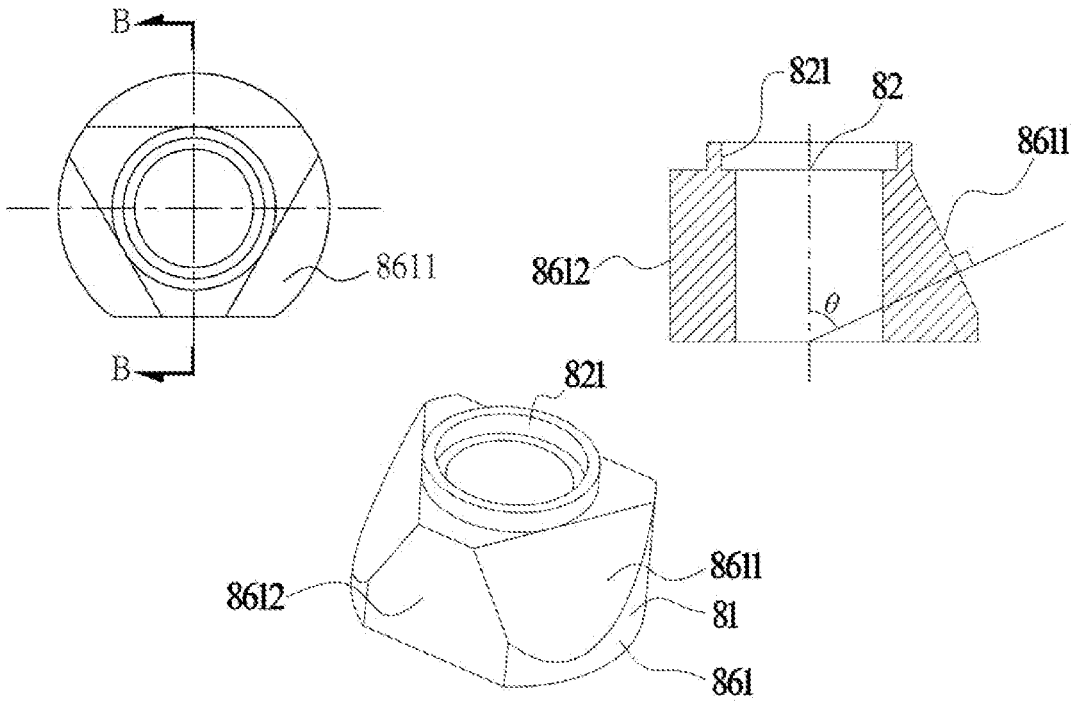
FIG. 12(*a*) illustrates appearance and section drawings of top annular surface of fixed ring used in the present invention.
Figure 12B:
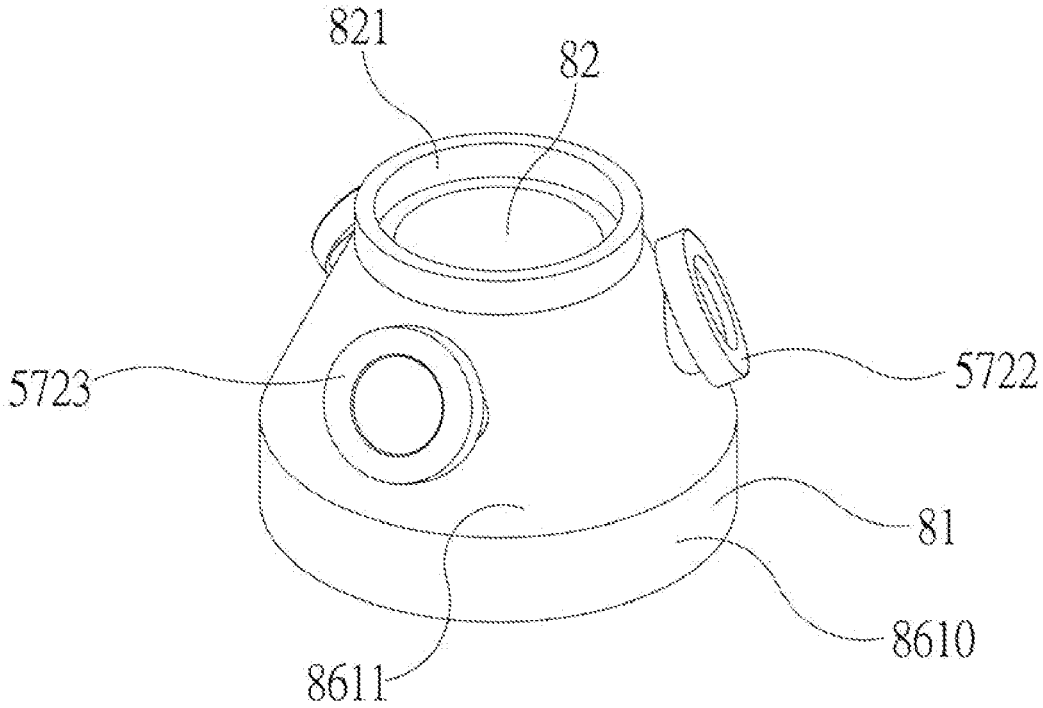

Please refer to FIG. 12, detailed structure diagram of top annular surface of fixed ring used in Embodiment 2 of the present invention. FIG. 12(*a*) explains that top annular surface 861 is equipped with three faying surfaces 8611 with oblique angle. The oblique angle Θ of faying surface 8611 is defined with the included angle between vertical normal and shaft axes. Range of Θ is from 90 degrees to 20 degrees. Transparent package 85 (as per FIG. 4) shall fill in upper part of central hole for shaft 821 when packaging and align with central hole for shaft 82. The fastener's fixed surface 8612 can be trimmed vertical plane used to fix wire fastener (as per FIG. 4). FIG. 12(*b*) shows that when top annular surface 861 has circular conical surface 8611, the underside of bearing disc 5722 can maintain level according to conical curved surface and bearing disc flange face 5723 for production of charge tape.

Embodiment 3 is annular lead frame that is installed on the top annular surface of fixed ring. This embodiment illustrates series and parallel circuit annular lead frame and the charge tape of monochromatic packaged LED 40.

Figure 5A:
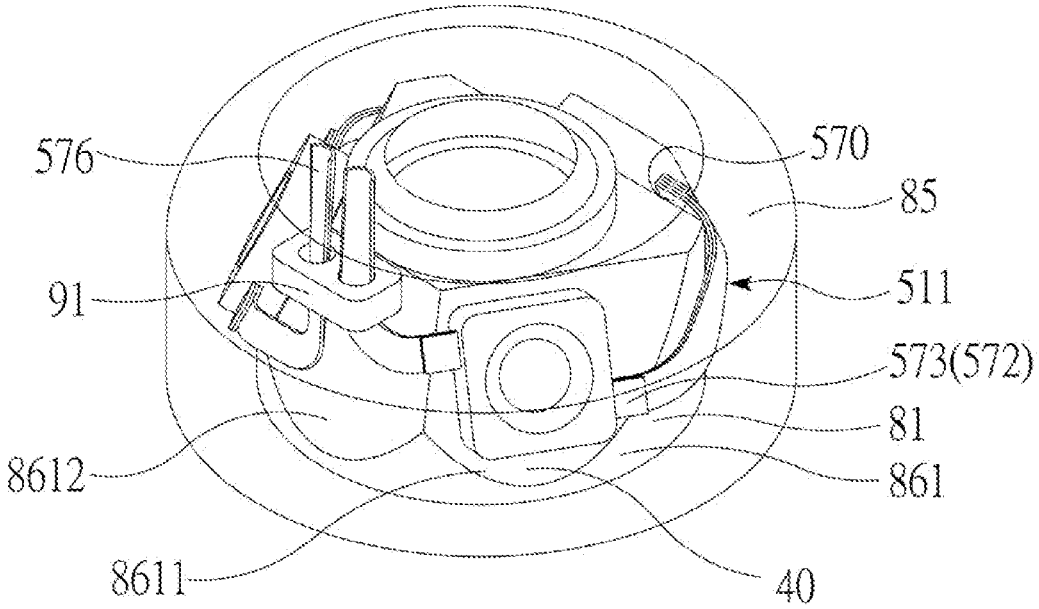
FIG. 5(*a*) illustrates structure of annular lead frame of monochromatic packaged LED series circuit used in the third embodiment of the present invention.
Figure 5B:
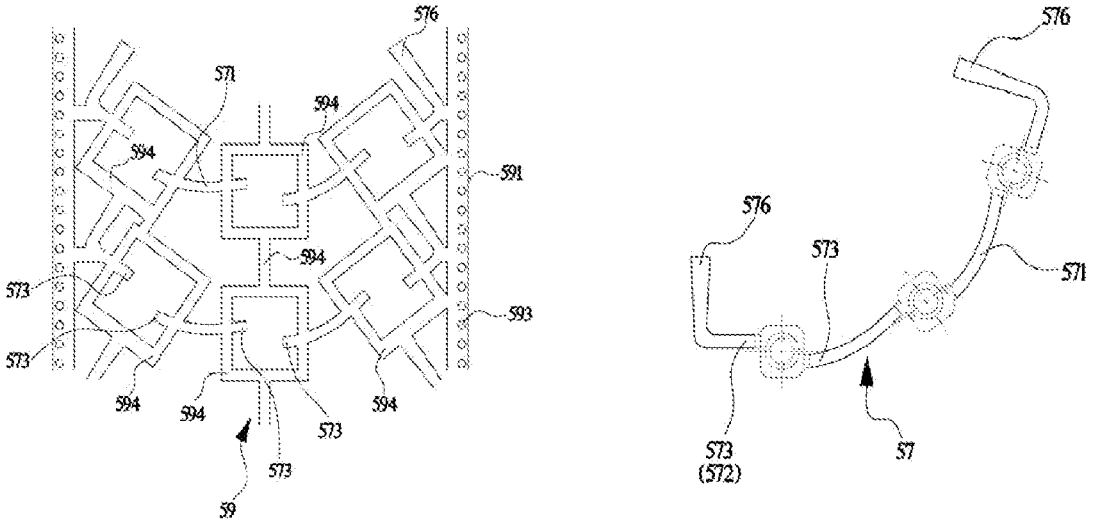
Figure 5C:
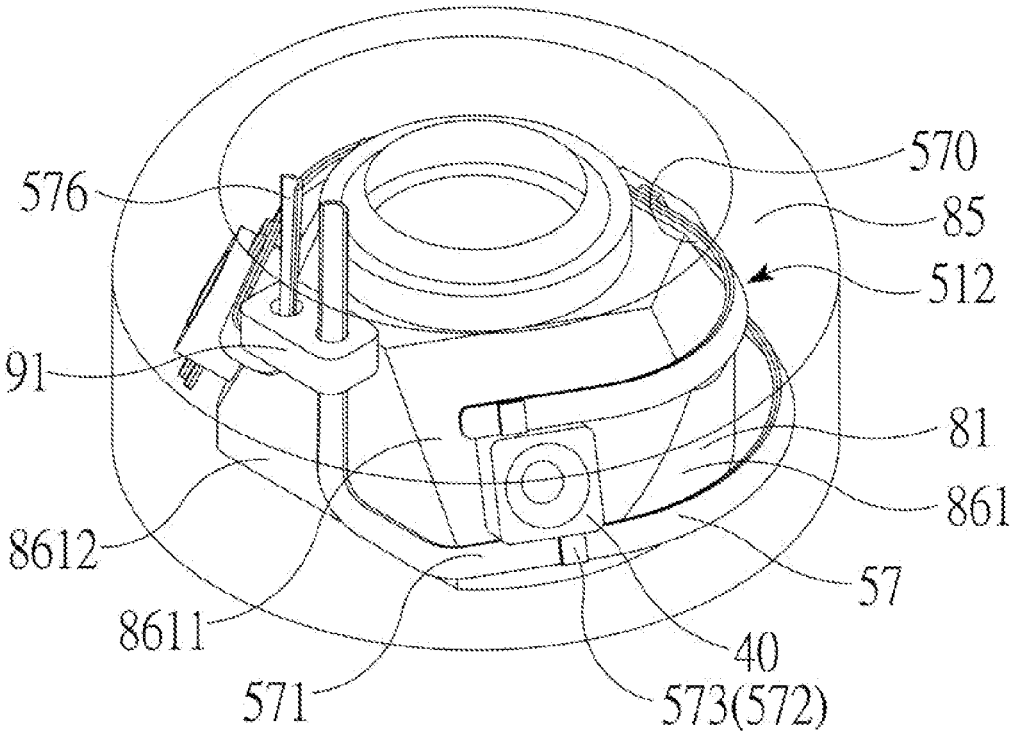
Figure 6A:
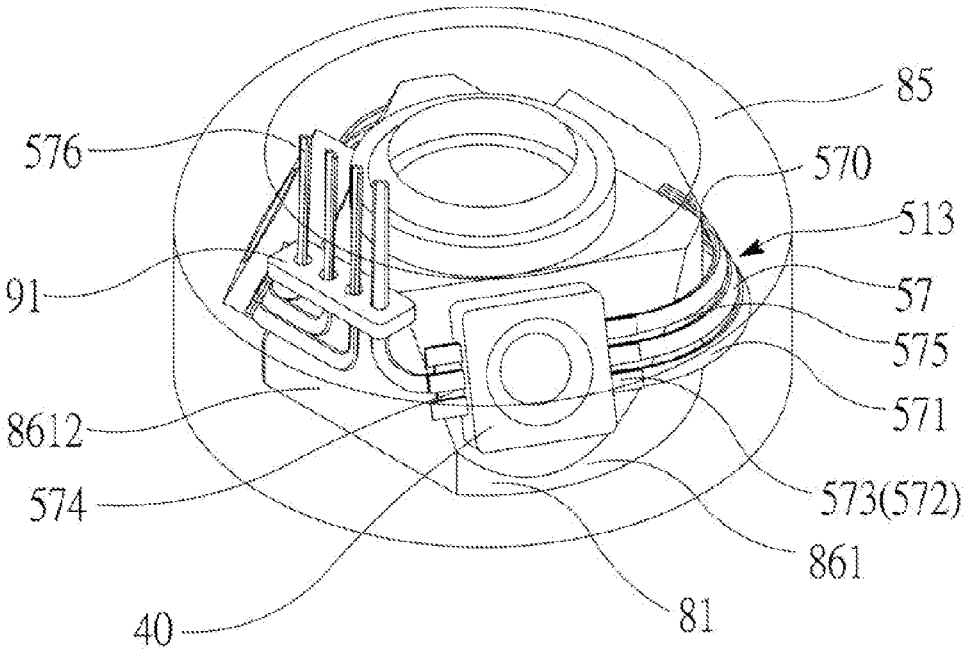
FIG. 6(*a*) illustrates structure of annular lead frame structure of multicolor packaged LED series circuit used in the fourth embodiment of the present invention.
Figure 6B:
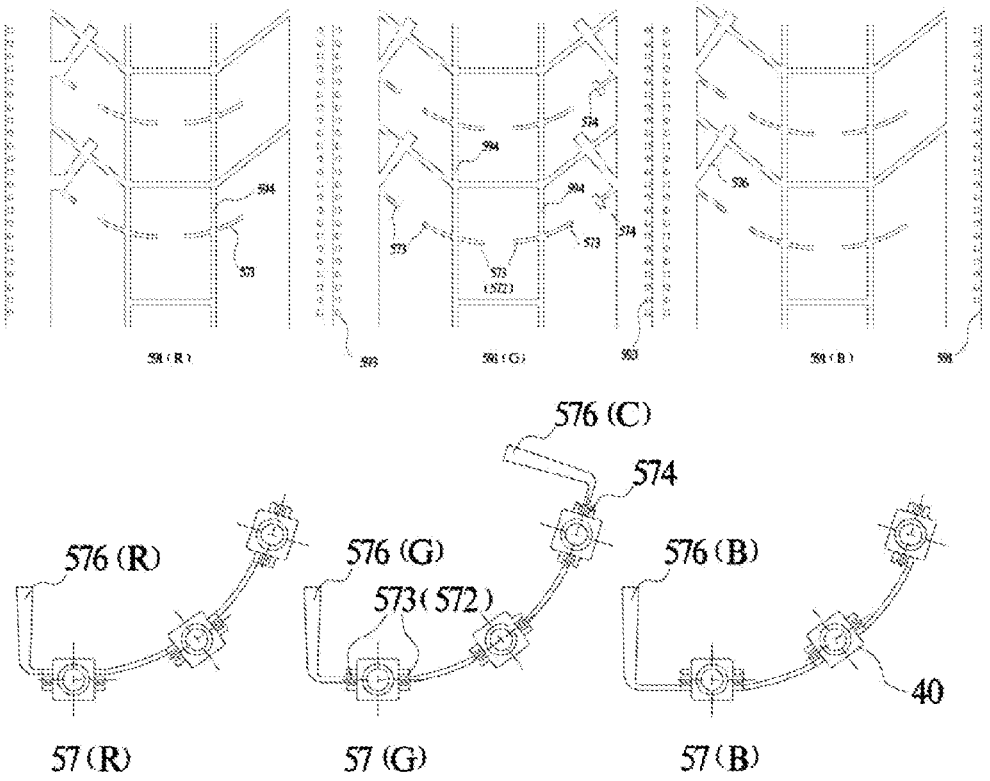
Figure 6C:
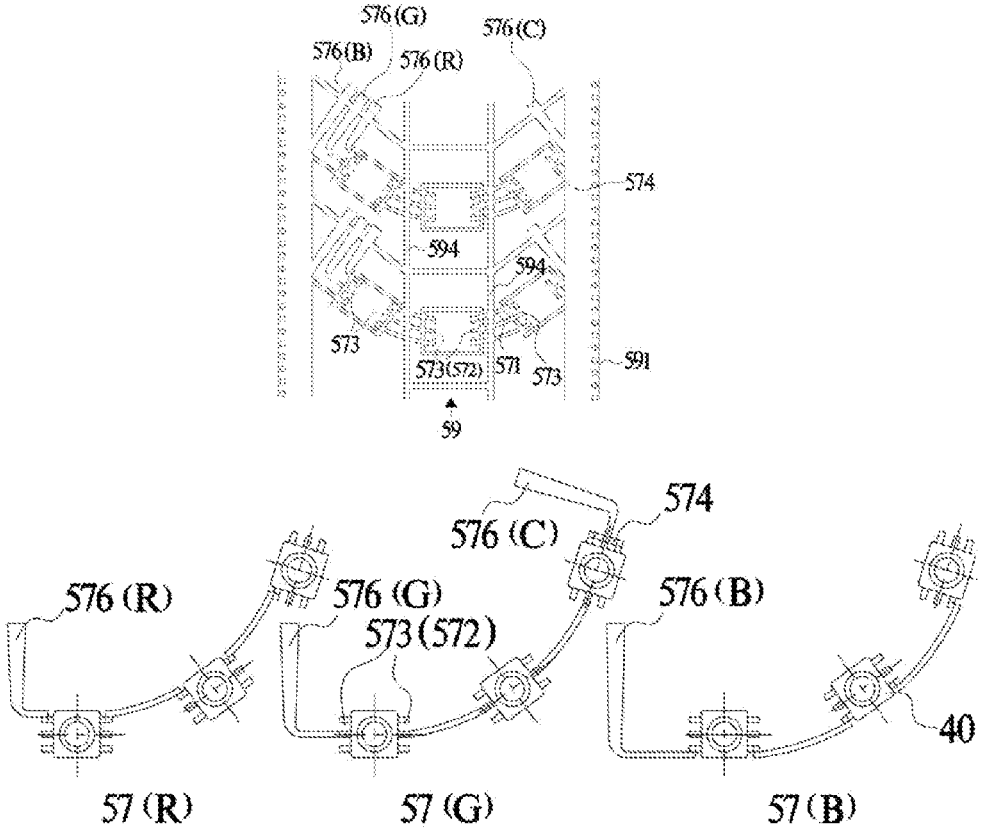
Figure 6D:
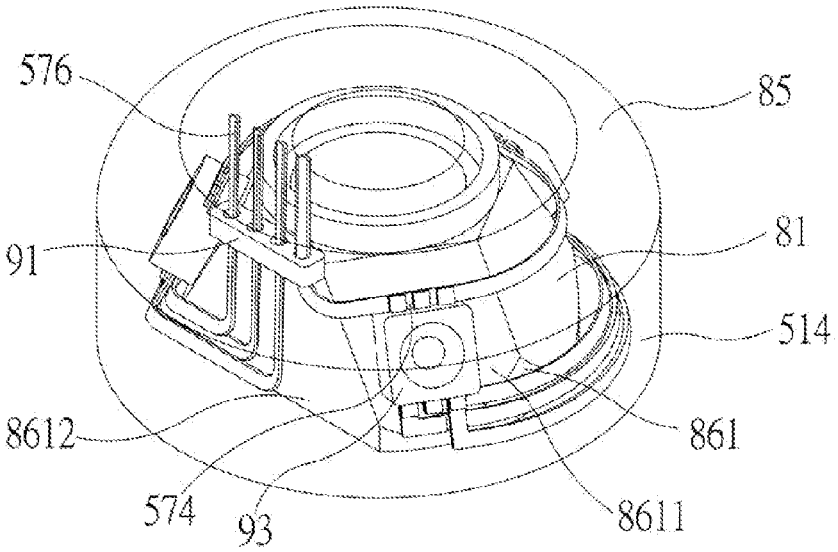
Figure 7A:
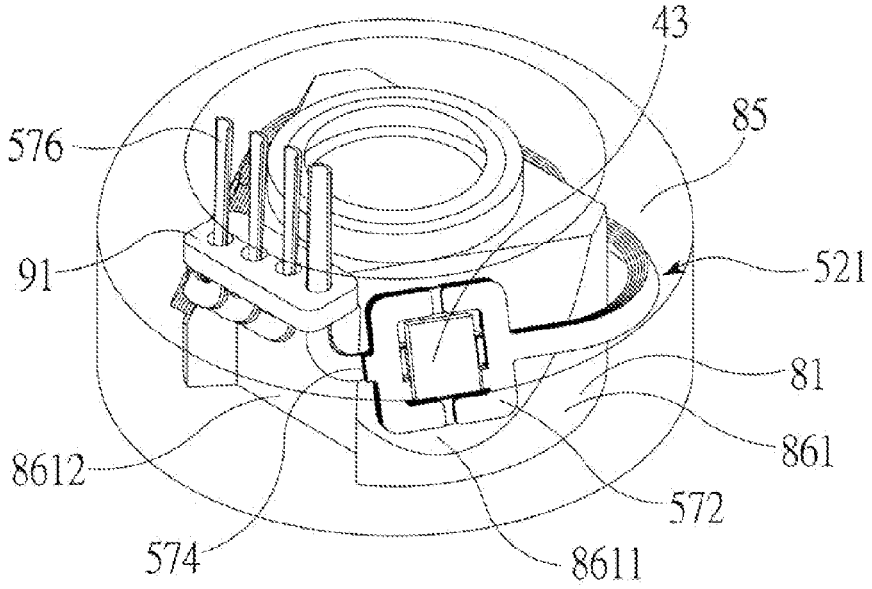
FIG. 7(*a*) illustrates structure of annular lead frame of multicolor SMD LED series circuit used in the fifth embodiment of the present invention.
Figure 7B:
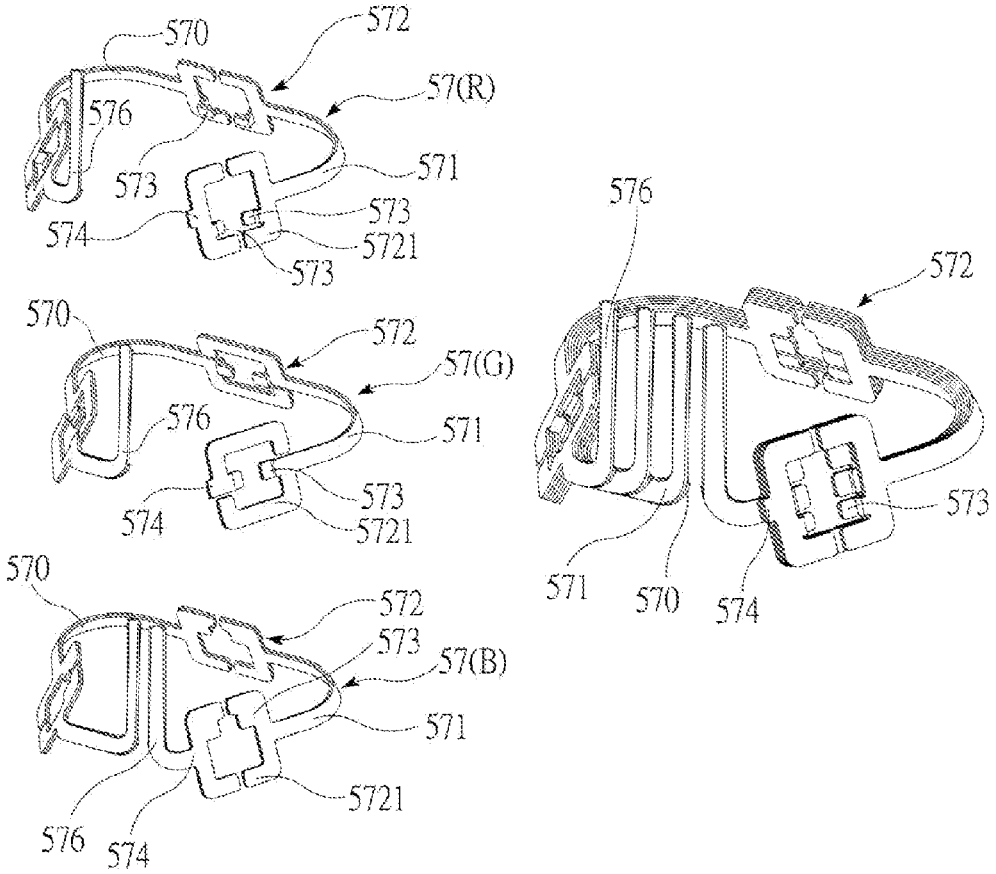
Figure 7C:
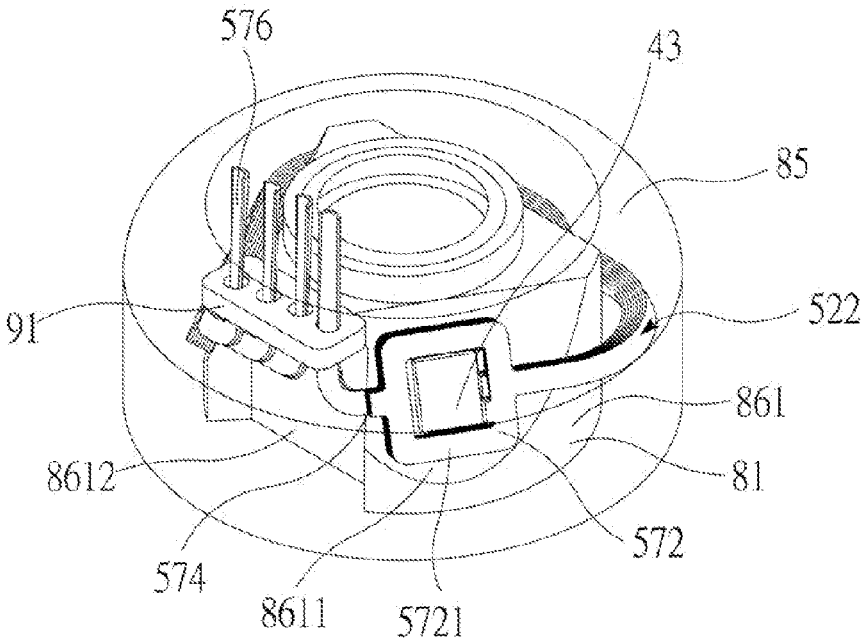
Figure 7D:
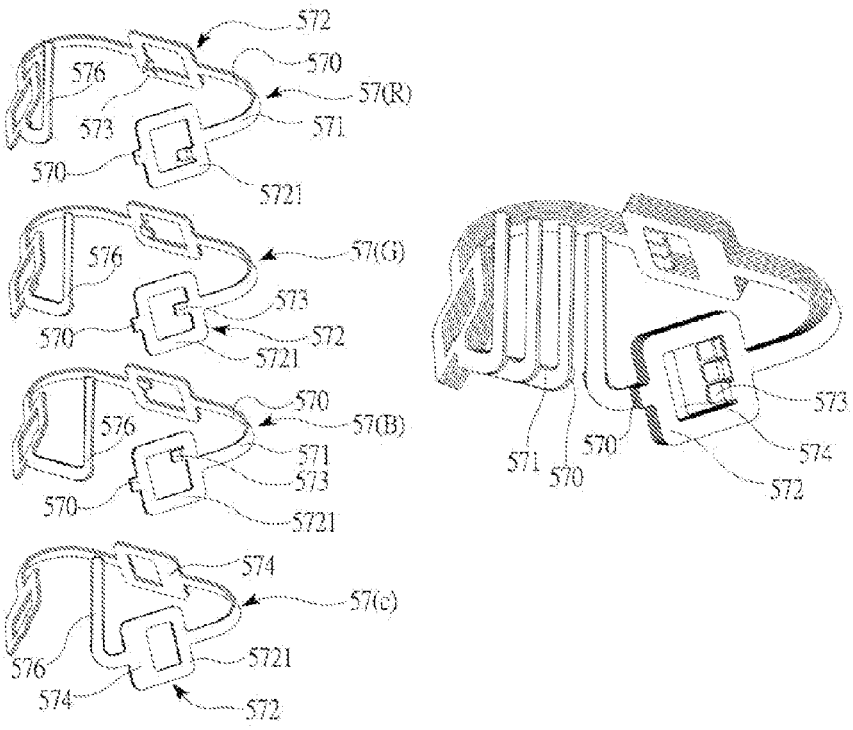
Figure 7E:
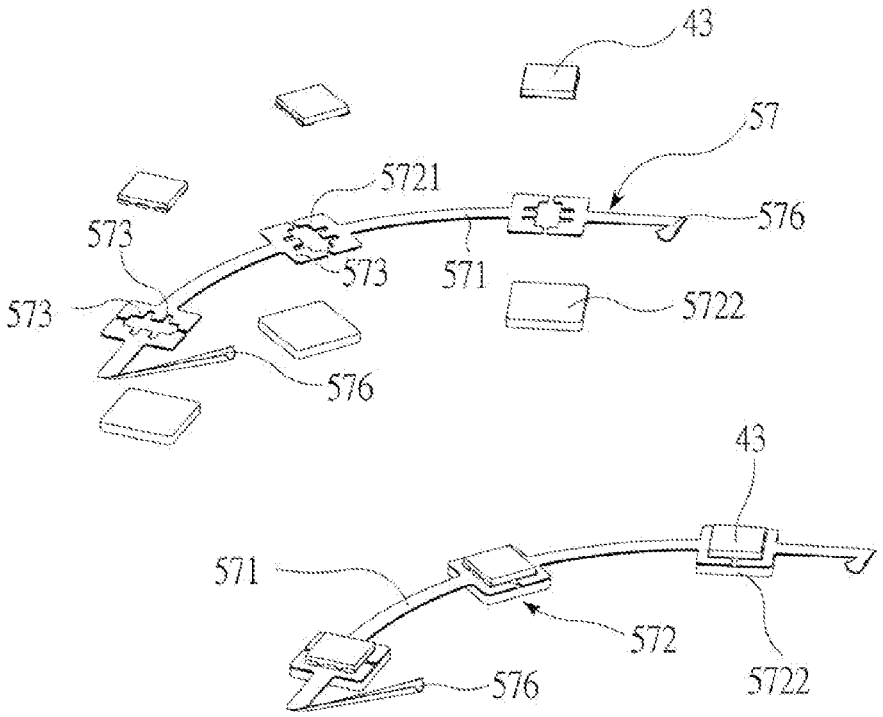
Figure 7F:
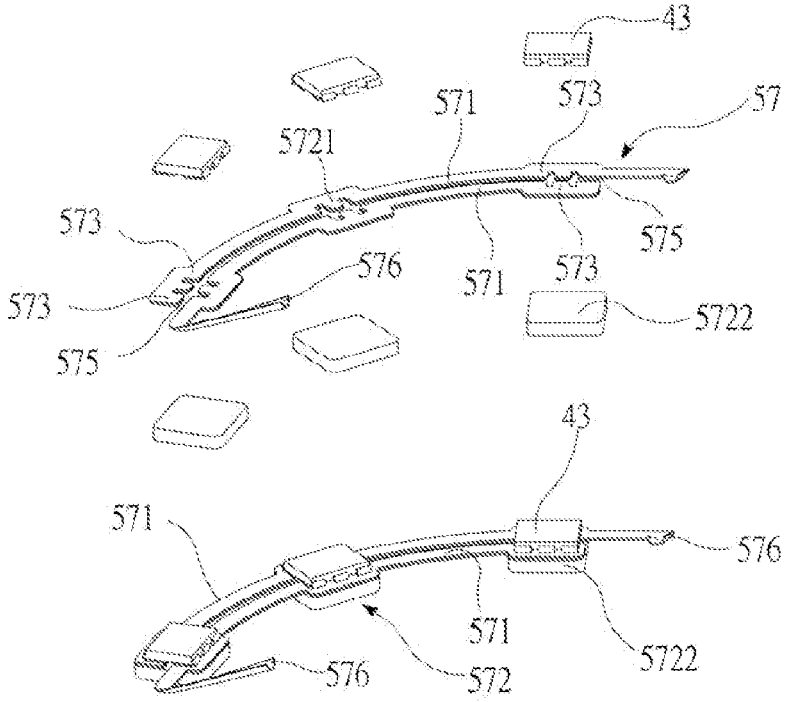
Figure 7G:
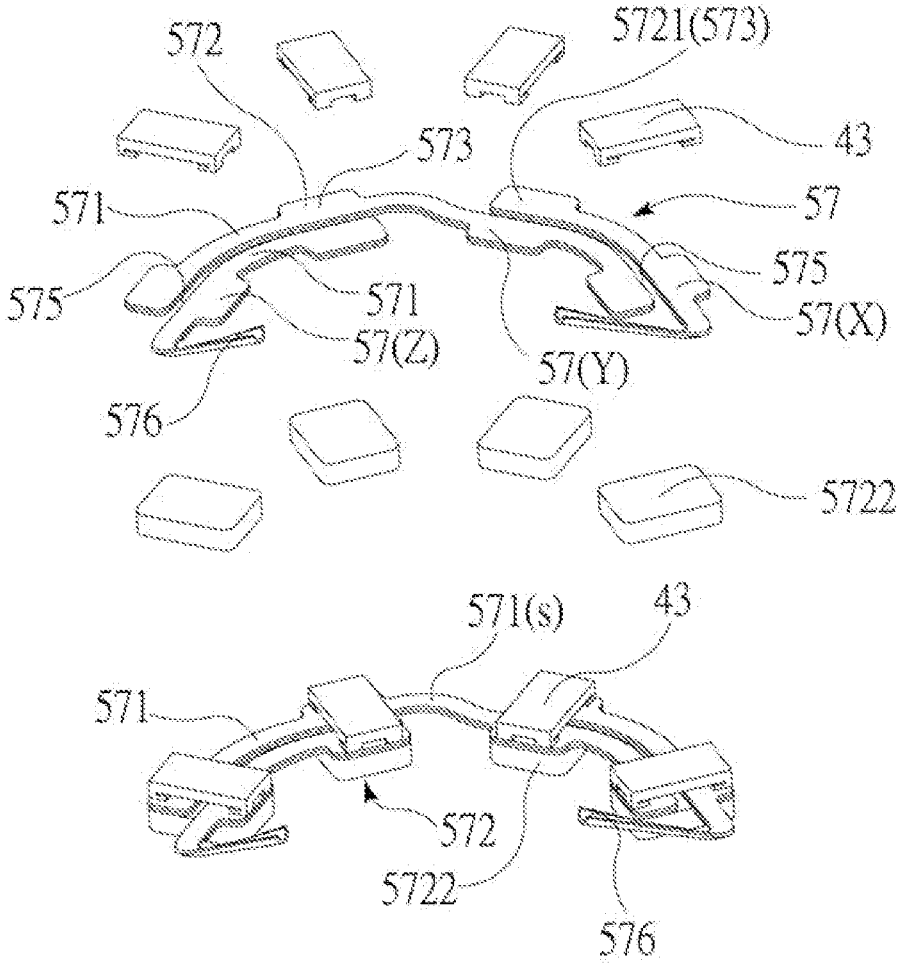
Figure 8A:
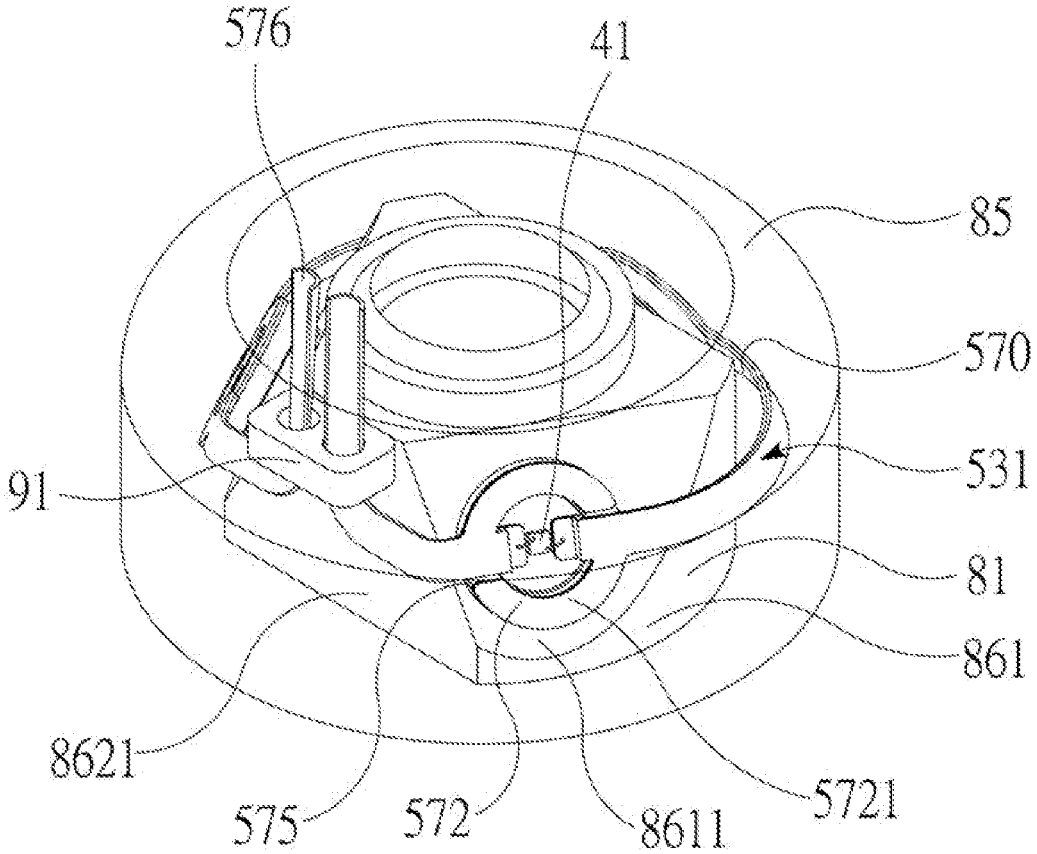
FIG. 8(*a*) illustrates structure of annular lead frame of coplanar electrode monochromatic bare chip LED series circuit used in the sixth embodiment of the present invention.
Figure 8B:
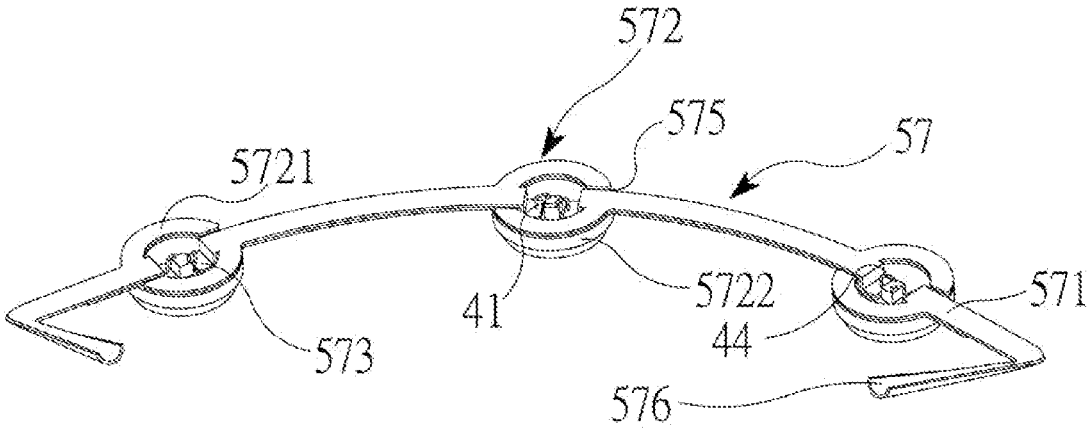
Figure 8C:
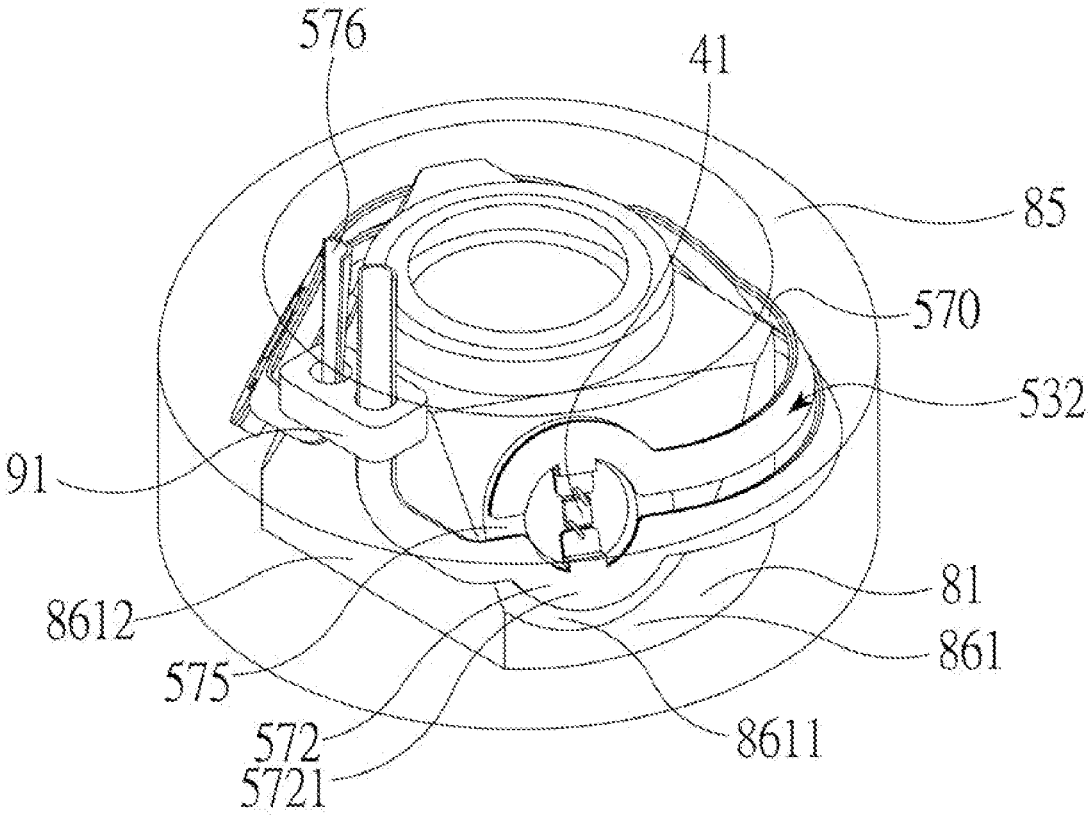
Figure 8D:
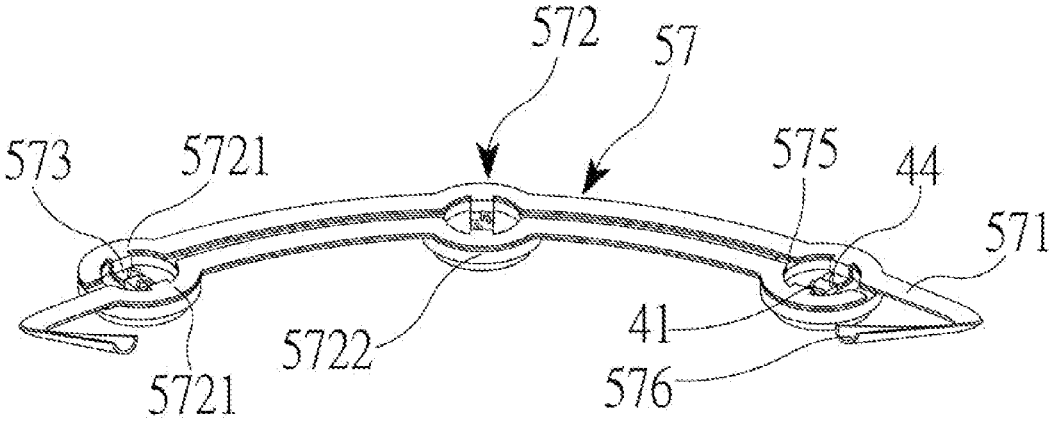
Figure 8E:
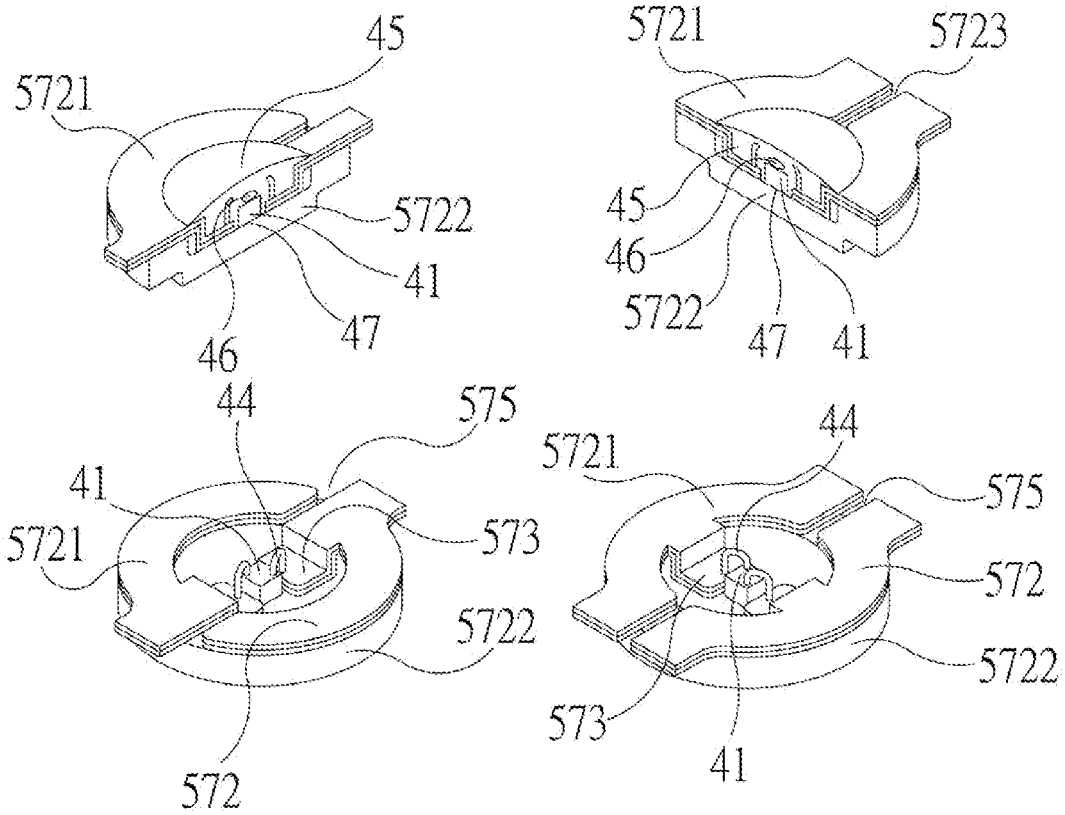
Figure 9A:
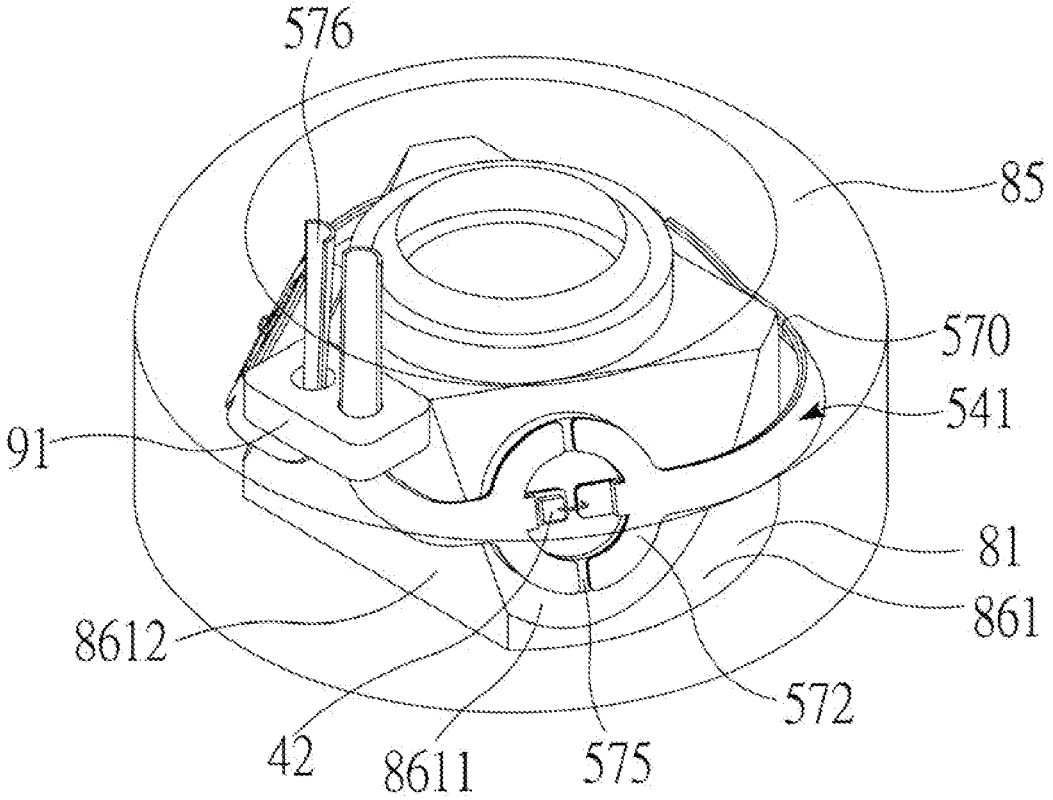
FIG. 9(*a*) illustrates structure of annular lead frame of monochromatic bare chip LED series circuit of upper and lower electrodes used in the seventh embodiment of the present invention.
Figure 9B:
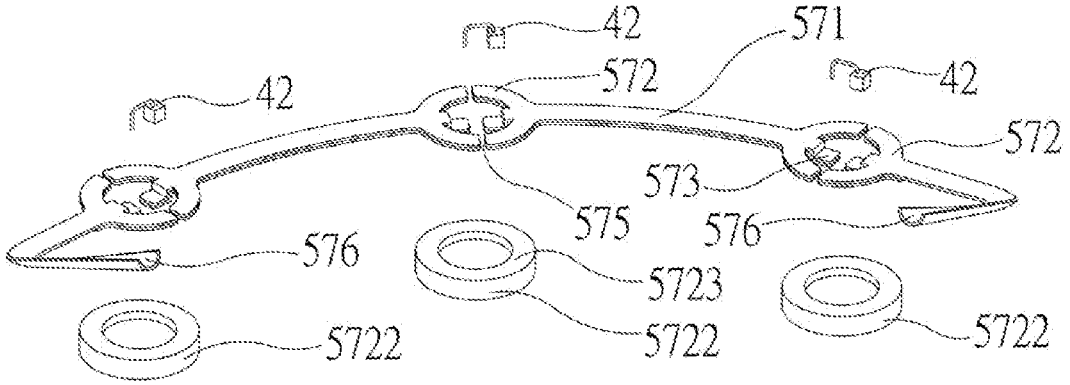
Figure 9C:
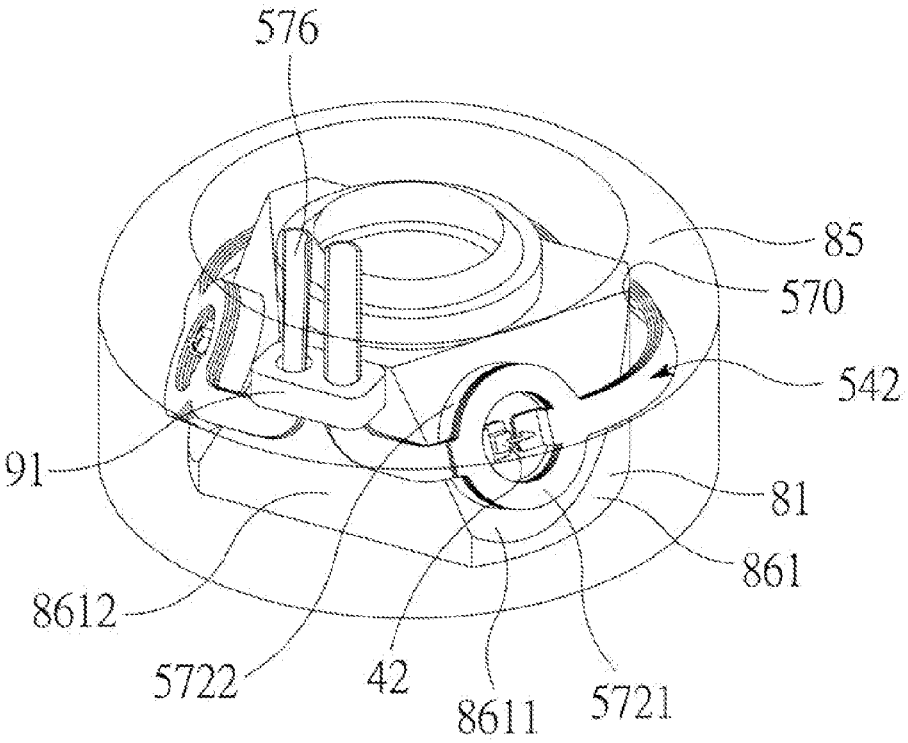
Figure 9D:
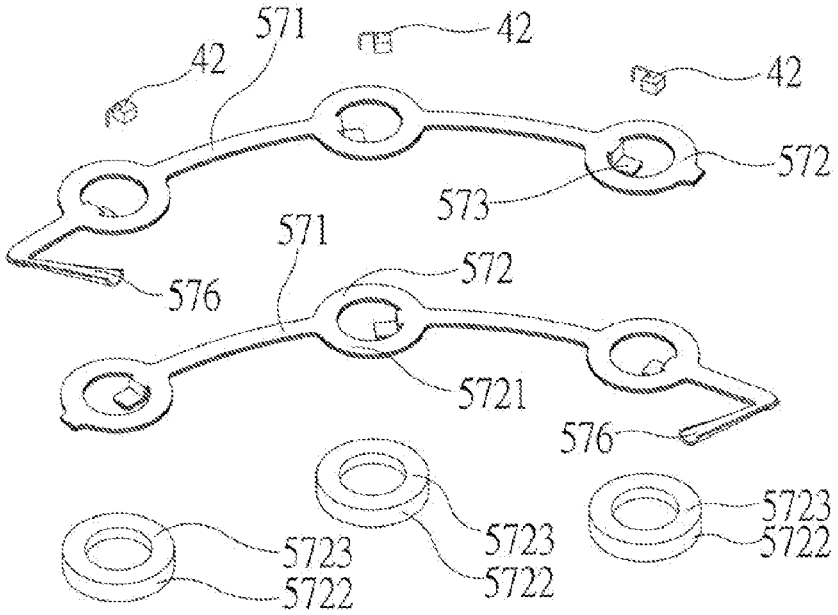
Figure 10A:
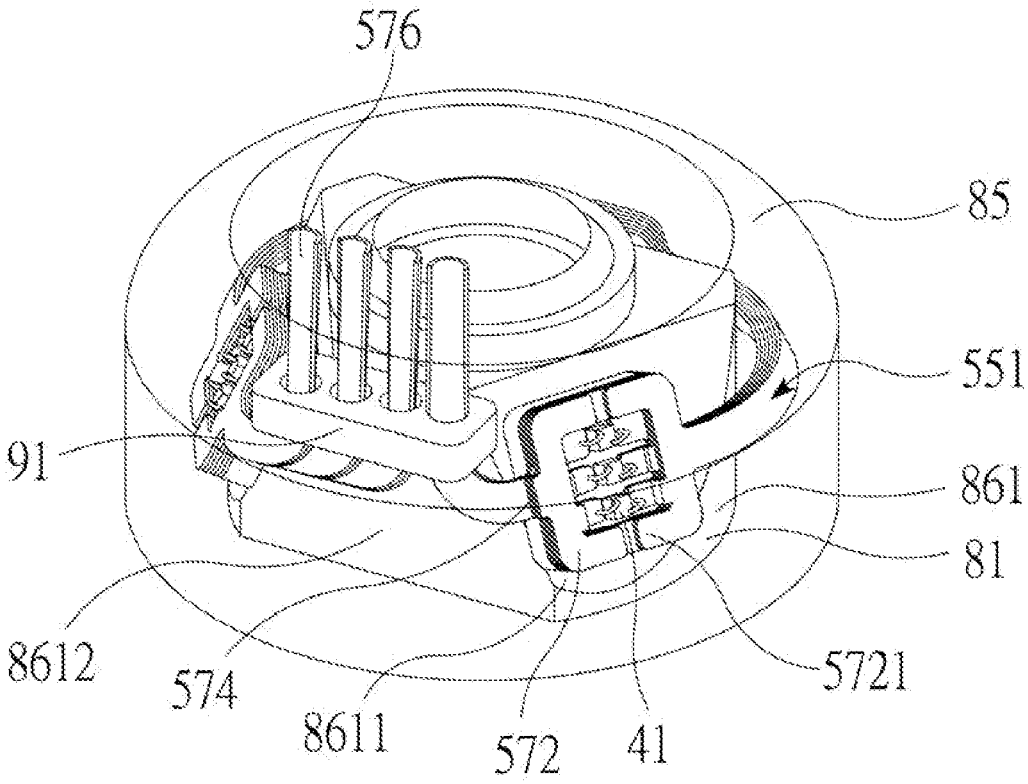
FIG. 10(*a*) illustrates structure of annular lead frame of coplanar electrode multicolor bare chip LED series circuit used in the eighth embodiment of the present invention.
Figure 10B:
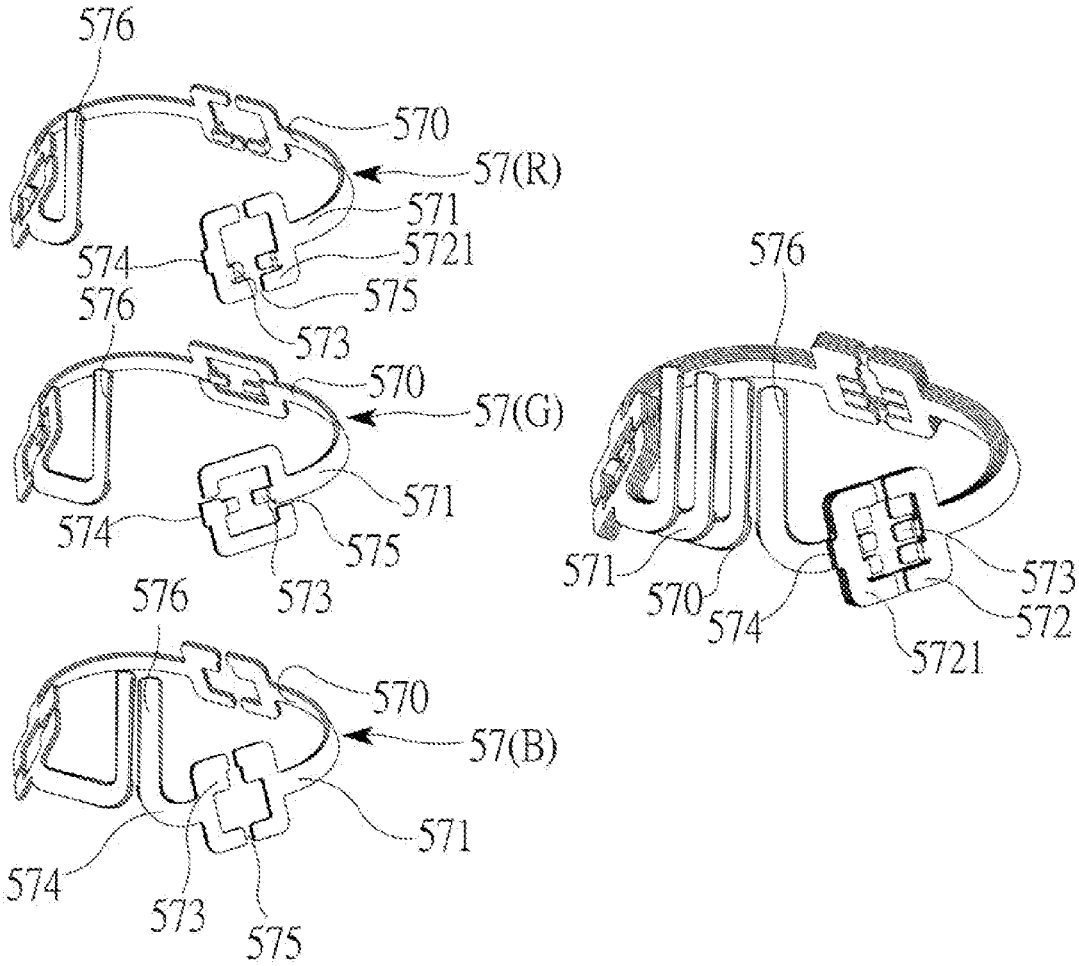
Figure 10C:
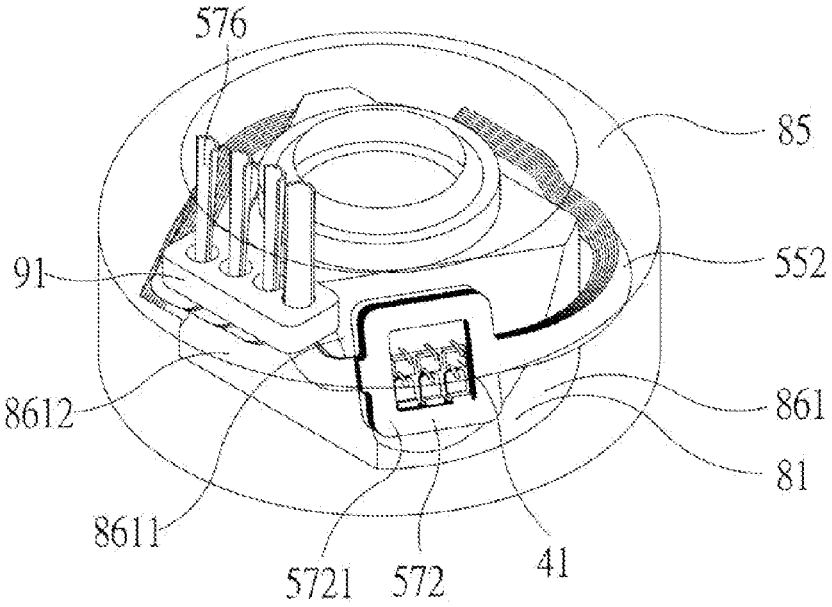
Figure 10D:
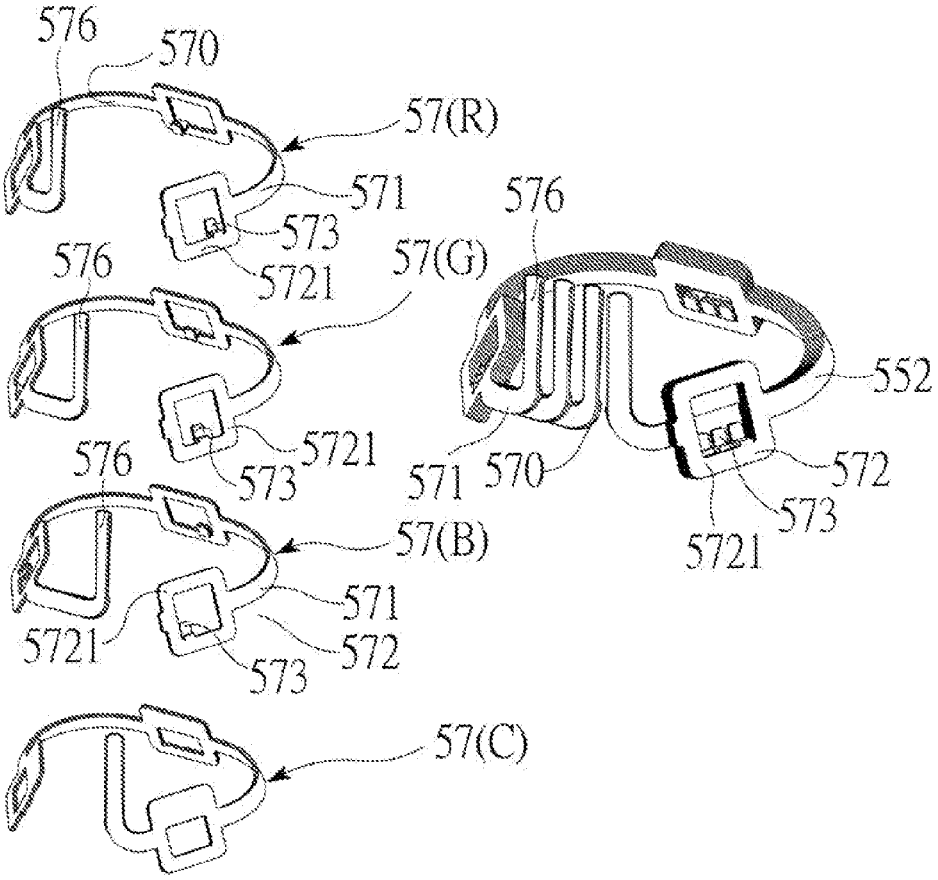
Figure 10E:
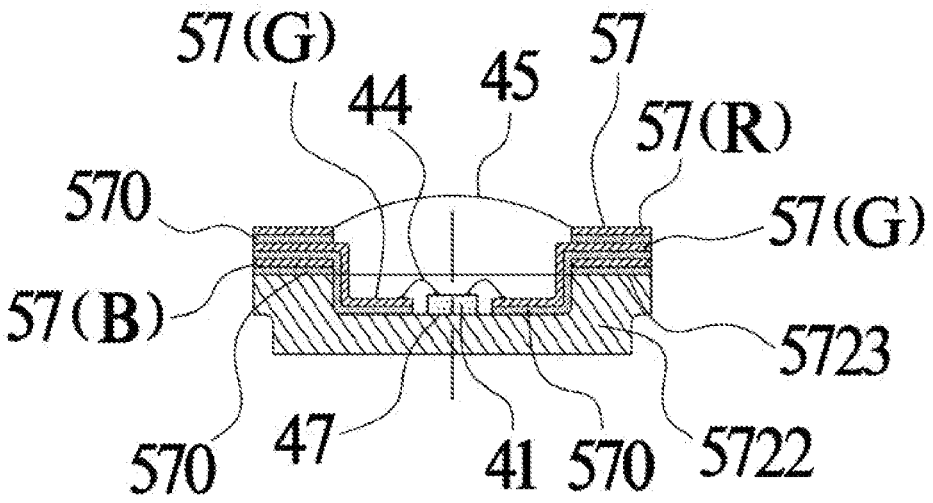
Figure 10F:
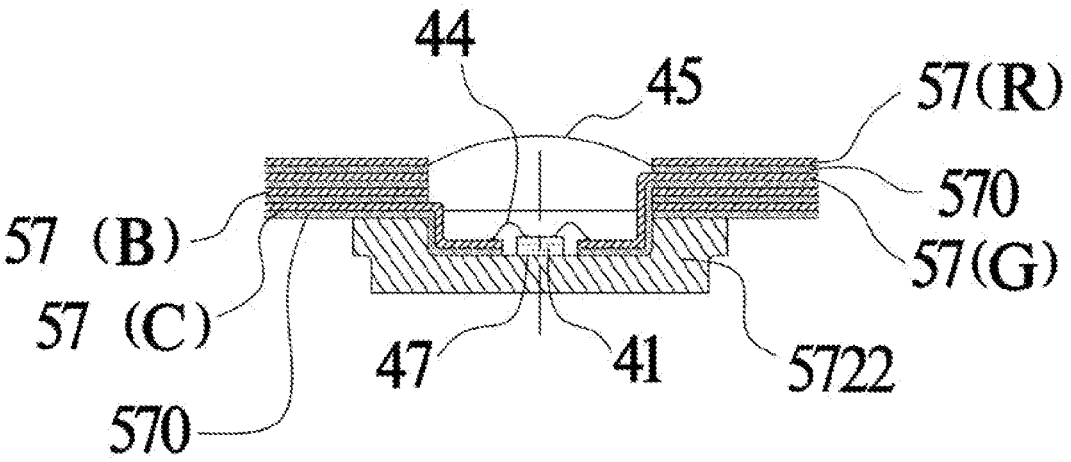
Figure 11A:
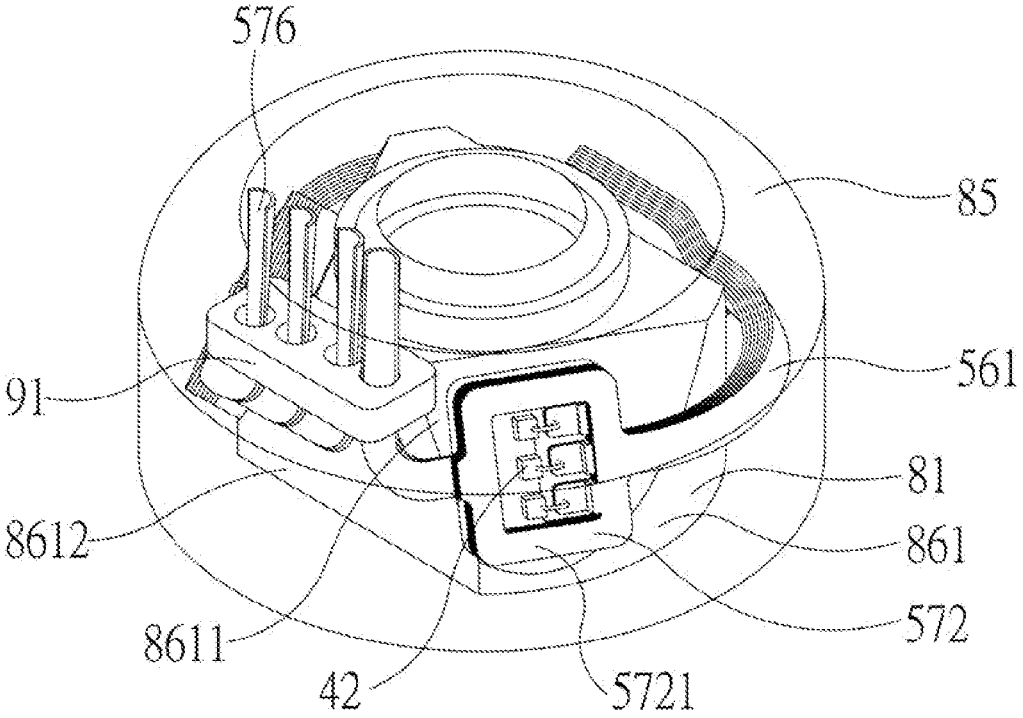
FIG. 11(*a*) illustrates structure of annular lead frame of multicolor bare chip LED parallel circuit of upper and lower electrodes used in the ninth embodiment of the present invention.
Figure 11B:
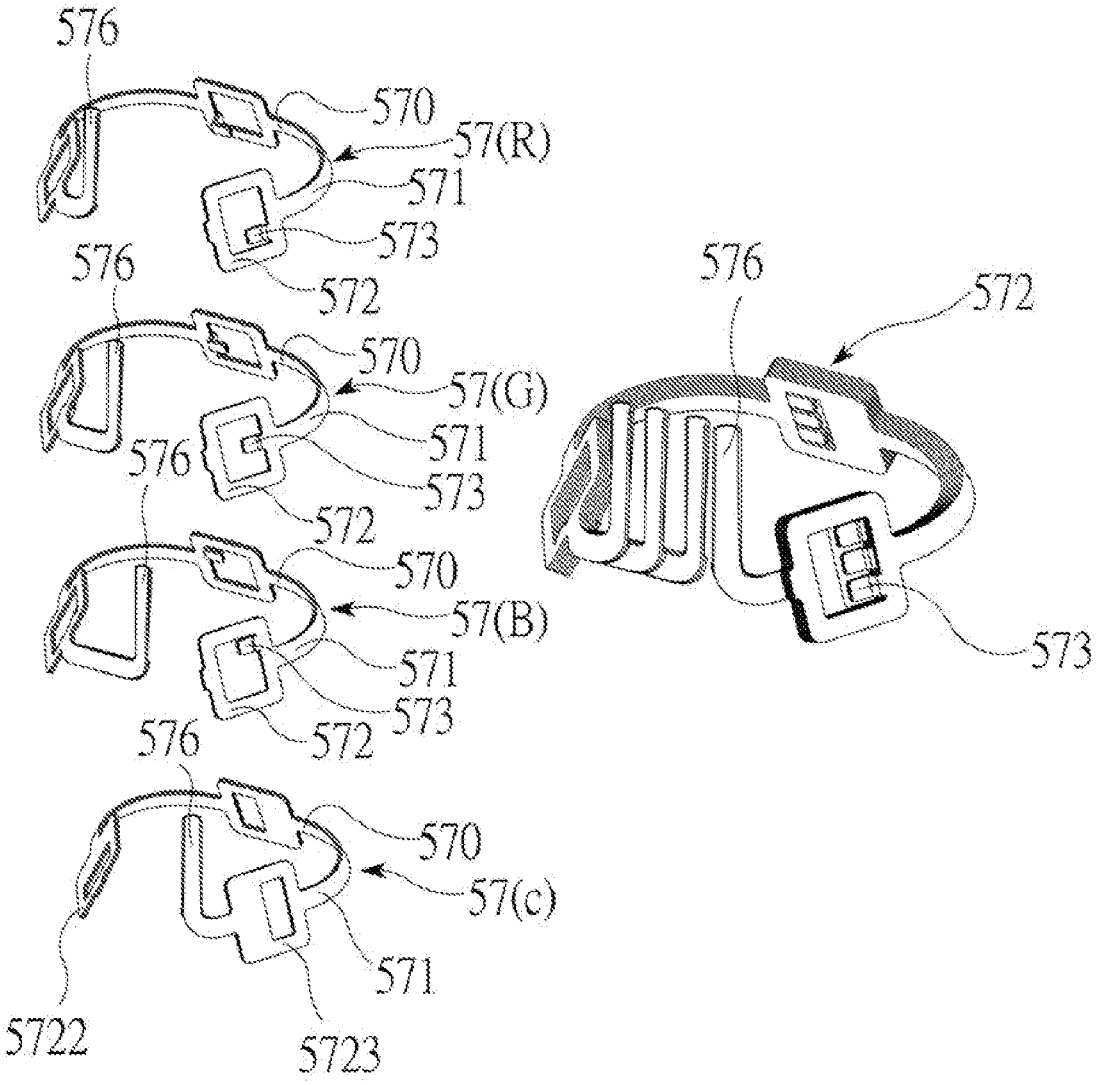
Figure 11C:
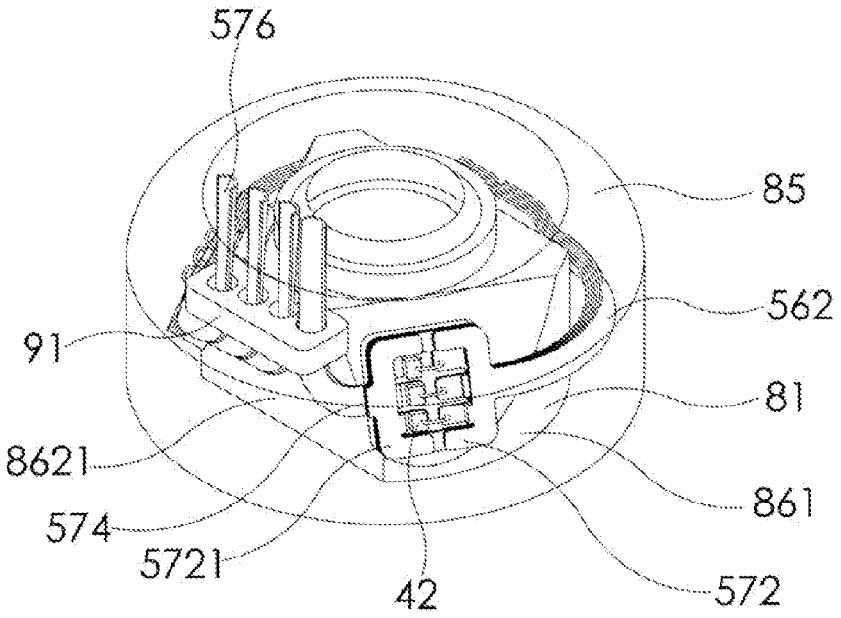
Figure 11D:
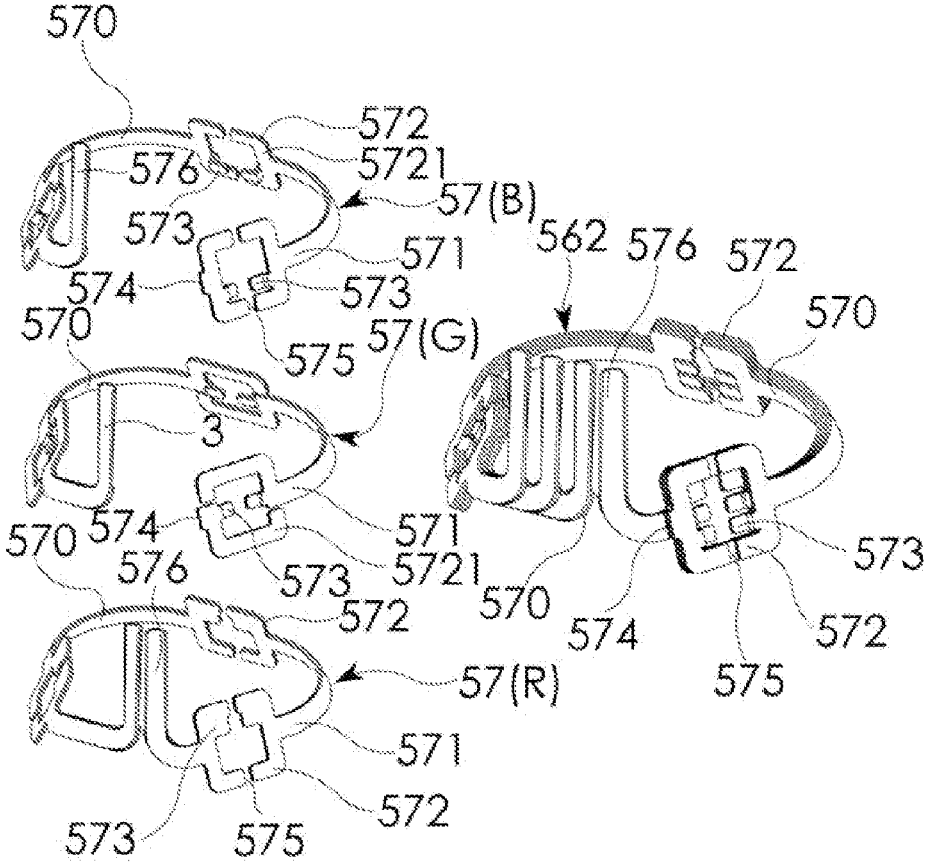
Figure 11E:
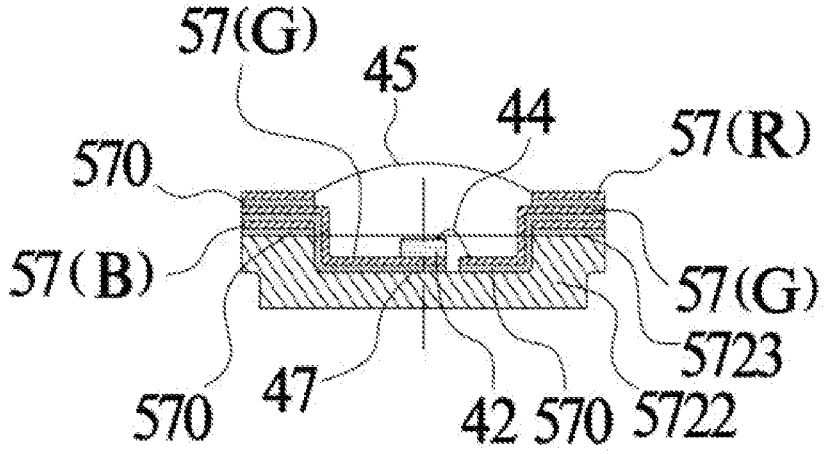
Figure 11F:
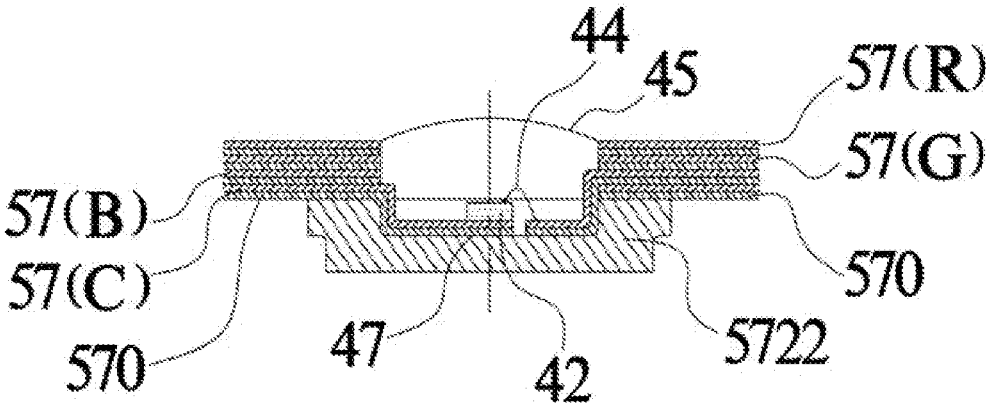

Please refer to FIG. 5(*a*), structure diagram of series annular lead frame of monochromatic packaged LED 40 used in the present invention. Top annular surface 861 of main fixed ring body 81 is installed with annular lead frame 511. Top annular surface 861 is also equipped with faying surface 8611 to paste heat dissipating baseplate of monochromatic packaged LED 40. The fastener's fixed surface 8612 is used to fix wire fastener 91. The manufacturing method of annular lead frame 511 is first bend LED lead frame of monochromatic packaged LED 40 into form, fix power pins 576 on two ends with fastener 91 to get one annular lead frame 511, after fixing on main movable collar body 81, use transparent materials to complete transparent package 85. The appearance of transparent package 85 can be adjusted according to the required light type.

Please refer to FIG. 5(*b*), structure diagram of series annular lead frame 511 of monochromatic packaged LED 40 of integrated illumination part used in the present invention. This figure aims to explain the composition and production methods of single-layer lead frame. The lead frame is serial lead frame. Charge tape 59 of monochromatic series lead frame properly arranges the patterns of the required single-layer lead frame 57 on conductive sheet metal. The back of sheet metal is equipped with insulating layer 570 (as per FIG. 5(*a*)) to prevent circuit short. After the first processing of conductive sheet metal, the prototype of lead frame with basic dimension can be obtained. The prototype contains wire 571, installation seat 572, power pin 576 and connecting part 594. Each installation seat 572 consists of a group of high and low potential electrode contacts 573. Connecting parts 594 with various shapes are used to connect and fix plural prototypes of lead frame together, maintain the shape of charge tape 59, and ensure stable position of electrode contact 573 by connecting part 594. Broadside 591 of each charge tape 59 is equipped with plural charge tape locating holes 593. To installing charge tape 59 on the jig, the conductive adhesive is dripped on each electrode contact 573 of charge tape 59 via glue dispersion machine, install the individual monochromatic packaged LED 40 on each electrode contact 573 to conduct heating and solid jointing and enable LED chip 40 to be broken over and steadily combined. The power pin 576 of charge tape 59 can be processed into form with the required shape and flexing angle. In the meanwhile, cut off connecting part 594 to enable each single-layer lead frame 57 to separate into LED lead frame with power pins 576 on both ends.

Please refer to FIG. 5(*c*), structure diagram of monochromatic LED parallel annular lead frame used in the present invention. Top annular surface 861 of main fixed ring body 81 can be installed with annular lead frame 512. Top annular surface 861 is also equipped with faying surface 8611 to paste heat dissipating baseplate of monochromatic packaged LED 40. The fastener's fixed surface 8612 is used to fix wire fastener 91. The manufacturing method of annular lead frame 512 is first bend monochromatic packaged LED 40 into form, fix power pins 576 on two ends with fastener 91 to get one annular lead frame 512, after fixing on main fixed ring body 81, use transparent materials to complete transparent package 85. The parallel LED lead frame of monochromatic packaged LED 40 consists of two pieces of separated abreast single-layer lead frames 57 and monochromatic packaged LED 40. Each piece of single-layer lead frame 57 belongs to continuous lead frame. These two pieces of single-layer lead frames 57 are welded and fixed with electrode contact of monochromatic packaged LED 40 and electrode contact 573 of installation seat 572. Each of the two pieces of abreast single-layer lead frames 57 includes one high potential and one low potential with plural wires 571, insulating layer 570, more than one installation seats 572 and one power pin 576. Each installation seat 572 consists of one group of high and low potential electrode contacts 573. Electrode contact 573 is connected with wire 571 in series connection. More than one electrode contacts 573 enable monochromatic packaged LED 40 to be connected with the circuit in parallel connection. That is, both ends of each section of wire 571 are connected with power pins 576 and electrode contacts 573. The power pins 576 and electrode contacts 573 are mutually separated in relative position of each single-layer lead frame 57 in order to be connected with high and low potential electrode contacts of monochromatic packaged LED 40.

Embodiment 4 illustrates annular lead frame that is installed on top annular surface, and series and parallel circuit annular lead frame 513 and the charge tape 59 of multicolor packaged LED 40 of integrated illumination part.

Please refer to FIG. 6(*a*), structure diagram of annular lead frame of multicolor packaged LED series circuit used in the present invention. Top annular surface 861 of main fixed ring body 81 can be installed with annular lead frame 513. Top annular surface 861 is also equipped with faying surface 8611 to paste heat dissipating baseplate of multicolor packaged LED 40. The fastener's fixed surface 8612 is used to fix wire fastener 91. The manufacturing method of annular lead frame 513 is first bend LED lead frame of multicolor packaged LED 40 into form, fix power pins 576 on two ends with fastener 91 to get one annular lead frame 513, after fixing on main fixed ring body 81, use transparent materials to complete transparent package 85. In addition, it is allowed to respectively input proper voltage via power pin 576 according to the demand of multicolor packaged LED 40. The appearance of transparent package 85 can be adjusted according to the light type. Annular lead frame 513 of multicolor packaged LED 40 contains three pieces of abreast single-layer lead frames 57 isolated by insulating joint 575. In these three pieces of parallel single-layer lead frames 57, only one piece of low potential power pin 576 has common contact 574. Each of the three pieces contains plural wire 571, insulating layer 570, more than one installation seats 572 and one high potential power pin 576. Each installation seat 572 consists of one group of high and low potential electrode contacts 573. Electrode contacts 573 are in series connection. Two high and low potential electrode contacts 573 enable multicolor packaged LED 40 to be connected with the circuit in series connection. Both ends of each section of wire 571 are connected with power pin 576 or common contact 574 as well as electrode contact 573. Each piece of single-layer lead frame 57 is serial lead frame. Power pin 576 and electrode contact 573 of each piece of lead frame 57 are mutually separated in relative position in order to be connected with high and low potential electrode contacts of multicolor packaged LED 40. The production of these three single-layer lead frames 57 can be completed on single-layer charge tape 59 in the same time or completed by stacking three pieces of single-layer charge tapes 59. FIG. 6(*b*) is the schematic diagram of three pieces of single-layer charge tapes 59 and single-layer lead frame 57.

Please refer to FIG. 6(*b*), structure of charge tape 59 in series annular lead frame 513 of multicolor packaged LED 40 of integrated illumination part used in the present invention. This figure aims to explain the composition and production methods of multicolor single-layer series lead frame's charge tape 59 and single-layer lead frame 57. Properly arrange the patters of the required red light single-layer lead frame 57(R), green light single-layer lead frame 57(G), blue light single-layer lead frame 57(B) on three pieces of conductive sheet metals with the same dimension. The back of sheet metal is equipped with insulating layer 570 (as per FIG. 6(*a*)) to prevent against circuit short circuit. Respectively make the first processing for conductive sheet metals, and get the prototype of lead frame with basic dimension. The prototype has wire 571, electrode contact 573, common contact 574, power pin 576 and connecting part 594. Connecting parts 594 with various shapes are used to connect and fix plural prototypes of lead frame together and maintain the shape of charge tape 59, and ensure stable position of electrode contact 573 by connecting part 594. Broadside 591 of each charge tape 59 is equipped with plural charge tape locating holes 593. Install these three pieces of charge tapes 59 on the jig and paste. Wire 571, electrode contact 573 and power pin 576 of each single-layer lead frame are respectively staggered. common contact 574 connects electrode pin of multicolor packaged LED 40. Conductive adhesive is dripped on each electrode contact 573 and common contact 574 via glue dispersion machine. Then install multicolor packaged LED 40 on each electrode contact 573 and common contact 574, conduct heating and solid jointing to enable LED chip 40 to be broken over and steadily combined. Power pin 576 of charge tape 59 can be processed into form with the required shape and flexing angle. Cut off connecting part 594 to become LED lead frame structure with three parallel lead frames 57. Each three parallel lead frames 57 has power pins 576 on both ends. The power pin can be further divided into three high potential 576(R), 576(G), 576(B) and a common potential 576(C). The common contact 574 is connected with common potential power pin 576(C).

Please refer to FIG. 6(*c*), structure of charge tape 59 in series annular lead frame 513 of multicolor packaged LED 40 of integrated illumination part used in the present invention. It especially explains that only one piece of charge tape 59 is used to produce multicolor single-layer series lead frame. Please refer to FIG. 6(*b*) for the symbols and explanation.

Please refer to FIG. 6(*d*), structure diagram of annular lead frame of multicolor packaged LED parallel circuit used in the present invention. Top annular surface 861 of main fixed ring body 81 can be installed with annular lead frame 514. Top annular surface 861 is equipped with faying surface 8611 to paste heat dissipating baseplate of multicolor packaged LED 40. The fastener's fixed surface 8612 is used to fix wire fastener 91. The manufacturing method of annular lead frame 514 is first bend color LED lead frame into form, fix power pins 576 on both ends with fastener 91 to enable it to become one annular lead frame 514, after fixing on main fixed ring body 81, use transparent materials to complete transparent package 85. Respectively input proper voltage via power pin 576 according to the demand of multicolor packaged LED 40. Because three high potential lead frame 57(R), 57(G) and 57(B) among these four parallel lead frames have part of wire that will be staggered and overlapped, the charge tape 59 must be separated for production. The production methods in relation to charge tape 59 are as shown in FIG. 6(*b*).

Embodiment 5 illustrates the annular lead frame that is installed on top annular surface of fixed ring, and series and parallel circuit annular lead frames of SMD LED 43 of integrated illumination part. This embodiment shall also apply to flip and bare chip LED and other electrode contact can be mounted on the surface mounted.

Please refer to FIG. 7(*a*), structure diagram of series annular lead frame of multicolor SMD LED 43 used in the present invention. Top annular surface 861 of main fixed ring body 81 can be installed with annular lead frame 521, top annular surface 861 is also equipped with faying surface 8611 to paste the bottom of installation seat 572, and fastener's fixed surface 8612 is used to fix wire fastener 91. The manufacturing method of annular lead frame 521 first bend color LED lead frame into form, fix power pins 576 on two ends with fastener 91 to get one annular lead frame 5, after pasting the underside of installation seat 572 on main fixed ring body 81, and proper voltage can be respectively input via power pin 576 according to the demand of multicolor SMD LED 43.

Please refer to FIG. 7(*b*), layered structure diagram of series annular lead frame 521 of multicolor SMD LED 43 is used in the present invention. This figure aims to explain the composition of multicolor single-layer series lead frame and annular lead frame 521. In order to produce annular lead frame 521, quantity of superimposed single-layer lead frames 57 and quantity of bare chips packaged in multicolor SMD LED 43 is related to the circuit arrangement. This embodiment takes RGB three-color chip parallel package as example, which should be superimposed with three layers of lead frame. The single-layer lead frames 57 includes red lead frame 57(R), green lead frame 57(G), blue lead frame 57(B), plural wire 571, insulating layer 570, more than one installation seats 572 and more than one power pins 576 or single common contact 574. Installation seat 572 consists of two installation seat wires 5721 isolated by insulating joint 575. The installation seat 572 has one group of high and low potential electrode contacts 573. The insulating joint 575 separate installation seat wire into two parts and changes single-layer lead frame 57 into serial lead frame. Electrode contact 573 of installation seat 572 is flexed to the height of the underside of installation seat 572, enabling multicolor SMD LED 43 (as per FIG. 7(*a*)) to be connected with the circuit in series connection. Both ends of each section of wire 571 are connected with power pin 576 or outside of common contact 574 as well as installation seat wire 5721. During superposition, electrode contact 573 and insulating joint 575 of installation seat 572 are mutually staggered. Wire 571 of each single-layer lead frame 57 and installation seat wire 5721 respectively have the same dimension. During superposition, they can be really mutually pasted and mutually insulated to form internal space for installation seat 572 where can be installed with SMD LED 43 (as per FIG. 7(*a*)). Based on rigidity of multilayer-superimposed structure, provide stable installation environment for SMD LED 43 (as per FIG. 7(*a*)). Charge tapes 59 of these three pieces of single-layer lead frames 57 can be produced according to the practice of FIG. 6(*b*), which contains overall dimension and flexing of electrode contact 573. Install these three pieces of single-layer charge tapes on the jig, solidly press and paste, and form one group of high and low potential electrode contacts 573 in installation seat 572. Conductive adhesive is dripped on each electrode contact 573 of charge tape via glue dispersion machine. Install multicolor SMD LED 43 (as per FIG. 7(*a*)) on electrode contact 573 of each installation seat 572. Conduct heating and solid jointing to enable multicolor SMD LED 43 to be broken over and steadily combined. Process power pin 576 of the charge tape into form with the required shape and flexing angle, in the meantime, cut off and take out LED lead frame with power pins 576 on both ends.

Please refer to FIG. 7(*c*), structure diagram of parallel annular lead frame 522 of multicolor SMD LED 43 used in the present invention. Top annular surface 861 of main fixed ring body 81 can be installed with annular lead frame 522. Top annular surface 861 is also equipped with faying surface 8611 to paste on the bottom of installation seat 572. The fastener's fixed surface 8612 is used to fix wire fastener 91. The manufacturing method of annular lead frame 511 is first bend color LED lead frame into form, fix power pins 576 on two ends with fastener 91 to get one annular lead frame 522. After pasting the bottom of installation seat on main fixed ring body 81, use transparent materials to complete transparent package 85, and proper voltage can be respectively input via power pin 576 according to the demand of multicolor SMD LED 43.

Please refer to FIG. 7(*d*), layered structure diagram of parallel annular lead frame 522 of multicolor SMD LED 43 used in the present invention. This figure aims to explain the composition of parallel individual single-layer lead frame and annular lead frame 522 of multicolor SMD LED. In order to produce annular lead frame 522, quantity of superimposed single-layer lead frames 57 and quantity of bare chips packaged in multicolor SMD LED 43 is related to the circuit arrangement. This embodiment takes RGB three-color chip parallel package as example, which should be superimposed with four pieces of single-layer lead frames 57. Each single-layer lead frames 57 respectively includes red lead frame 57(R), green lead frame 57(G), blue lead frame 57(B) and common ground lead frame 57(C). The single-layer lead frames 57 include plural wire 571, insulating layer 570, more than one installation seats 572 and one power pin 576. Installation seat 572 consists of one installation seat wires 5721 without insulating joint 575, having wire 571 in series connection. Single-layer lead frame 57 belongs to continuous lead frame, and one electrode contact 573 is just equipped on installation seat wire 5721. Electrode contact 573 is flexed to the height of the underside of installation seat 572. Red, green and blue single-layer lead frames 57 are mutually staggered on the superimposed electrode contact 573, which can connect high potential electrode contact of SMD LED 43 (as per FIG. 7(*c*)). Common ground lead frame 57(C) is placed on the bottom layer. The electrode contact 573 is connected with low potential electrode contact of SMD LED 43 (as per FIG. 7(*c*)). Electrode contact 573 of common ground lead frame 57(C) respectively constitutes one group of high and low potential electrode contacts 573 with electrode contact 573 of other single-layer lead frame 57. Both ends of each section of wire 571 are connected with power pin 576 and installation seat wire 5721, and wire 571 and installation seat wire 5721 of each layer of lead frame 57 has the same dimension. During superposition, they can be really mutually pasted and mutually insulated to form internal space for installation seat 572 where can be installed with SMD LED 43 (as per FIG. 7(*a*)). Provide stable installation environment based on rigidity of superimposed structure. Charge tapes 59 of these four pieces of single-layer lead frames 57 can be produced according to the practice of FIG. 6(*b*), which contains overall dimension and flexing of electrode contact 573. Install these four pieces of single-layer charge tapes on the jig, solidly press and paste, and form one group of high and low potential electrode contacts 573 in installation seat 572. Conductive adhesive is dripped on each electrode contact 573 of charge tape via glue dispersion machine. Install LED multicolor SMD LED 43 (as per FIG. 7(*a*)) on electrode contact 573 of each installation seat 572, conduct heating and solid jointing to enable the circuit to be broken over and steadily combined. Then process power pin 576 of the charge tape 59 into form with the required shape and flexing angle, in the meantime, cut off and take out LED lead frame with power pins 576 on both ends.

Please refer to FIG. 7(*e*), layered structure diagram of series LED lead frame of monochromatic or white light SMD LED 43 used in the present invention. This legend takes monochromatic or white light SMD LED 43 in parallel package of three bare chip LEDs. Annular lead frame 521 of monochromatic or white light SMD LED 43 chip contains one piece of single-layer lead frame 57 and more than one bearing discs 5722 of installation seat. Single-layer lead frame 57 has plural wire 571, insulating layer 570 (as per FIG. 7(*d*)), a plurality of installation seats 572 and power pins 576 on both ends. Installation seat 572 consists of two installation seat wires 5721 isolated by insulating joint 575, which has one group of electrode contacts 573 that can form high and low potential. Single-layer lead frame 57 is serial lead frame, which can connect joint circuit in series connection when SMD LED 43 is installed. The installation seat 572 and bearing disc 5722 of single-layer lead frame 57 have the same dimension, which can really mutually pasted during superposition to provide SMD LED 43 with stable installation environment based on the superimposed structural rigidity. Both ends of each section of wire 571 are connected with power pin 576 and installation seat wire 5721. The production of charge tape 59 of single-layer lead frame 57 can be completed according to the practice of FIG. 6(*b*). It contains overall dimension of electrode contact 573. Install installation seat bearing disc 5722 and this piece of single-layer charge tape on the jig, and solidly press and paste. Installation seat wires 5721 are separated by insulating joint 575. It can be firmly fixed with bearing disc 5722, and form installation seat 572 where can be installed with SMD LED 43. Seat wires 5721 form one group of high and low potential electrode contacts 573 in bearing disc 5722. Conductive adhesive is dripped on each electrode contact 573 via glue dispersion machine, and install monochromatic SMD LED 43 on electrode contact 573 of each installation seat 572, conduct heating and solid jointing to enable SMD LED 43 to be broken over and steadily combined. Process power pin 576 of the charge tape 59 into form with the required shape and flexing angle, in the meantime, cut off and take out LED lead frame with power pins 576 on both ends.

Please refer to FIG. 7(*f*), layered structure diagram of parallel LED lead frame of monochromatic SMD LED 43 used in the present invention. This legend uses monochromatic SMD LED 43 in parallel package of three bare chip LEDs. LED lead frame of monochromatic SMD LED 43 contains 2 pieces of parallel single-layer lead frames 57 isolated by insulating joint 575 and more than one bearing discs 5722. Two pieces of abreast single-layer lead frames 57 include one high potential and one low potential. Single-layer lead frame 57 belongs to continuous lead frame. Both of them have plural wire 571, insulating layer 570 (as per FIG. 7(*d*)), more than one installation seats 572 and one power pin 576. Power pin 576 and electrode contact 573 of two single-layer lead frames 57 are mutually separated in relative position of each single-layer lead frame 57 in order to connect with high and low potential electrode contacts of SMD LED 43. Each installation seat 572 jointly consists of installation seat wires 5721 of 2 pieces of single-layer lead frames 57, and has the same dimension as bearing disc 5722. During superposition, they can really be mutually pasted based in bearing disc 5722, and provide SMD LED 43 with stable installation environment based on the superimposed structural rigidity. Installation seat wire 5721 is connected with wire 571 in series connection, and each installation seat wire 5721 is equipped with more than one electrode contacts 573, enabling SMD LED 43 to be connected with the circuit in parallel connection. Both ends of each section of wire 571 are connected with power pin 576 and installation seat wire 5721. Complete the production of these two single-layer lead frames 57 in the meantime in single-layer charge tape 59 according to the practice in FIG. 6(*b*), it includes overall dimension of electrode contact 573. Install installation seat bearing disc 5722 and this piece of single-layer charge tape on the jig, firmly press and paste. At this time, installation seat wire 5721 separated by insulating joint 575 can be solidly fixed with bearing disc 5722 and form installation seat 572. Installation seat 572 can be installed with SMD LED 43. Installation seat wire 5721 form one group of high and low potential electrode contacts 573 in bearing disc 5722. Conductive adhesive is dripped on each electrode contact 573 of charge tape via glue dispersion machine. Install monochromatic SMD LED 43 on electrode contact 573 of each installation seat 572, conduct heating and solid jointing to enable SMD LED 43 to be broken over and steadily connected. Then power pin 576 of charge tape can be processed into form with the required shape and flexing angle, in the meantime, cut off and take out LED lead frame with power pins 576 on both ends.

Please refer to FIG. 7(*g*), layered structure diagram of series and parallel LED lead frame of monochromatic or white light SMD LED 43 used in the present invention. The circuit of this legend is the composite circuit in parallel connection and then series connection. This legend uses four monochromatic or white lights SMD LEDs 43 in parallel package of several bare chip LEDs. Three pieces of parallel single-layer lead frames 57 contain four bearing discs 5722 isolated by insulating joint 575, which are used to install these four SMD LEDs 43 into two one-group-parallel connection and two-group series connection circuit. Three pieces of parallel single-layer lead frames 57 can be divided into 57(X), 57(Y) and 57(Z). Single-layer lead frame 57(X) and single-layer lead frame 57(Z) have plural wire 571, insulating layer 570 (as per FIG. 7(*d*)). More than one installation seats 572 and one power pin 576. Installation seat wire 5721 on installation seat 572 is integrated with electrode contact 573. Single-layer lead frame 57(Y) has plural wire 571, one wire 571(S), insulating layer 570 (as per FIG. 7(*d*)) and more than one installation seats 572. Single-layer lead frame 57C has plural wire 571, insulating layer 570 (as per FIG. 7(*d*)) and more than one installation seats 572. Installation seat wire 5721 is integrated with electrode contact 573. Length of single-layer lead frame 57(Y) is the longest and wire 571(S) can provide series connection of circuit. Single-layer lead frame 57(X) and 57(Z) are respectively arranged at both sides of single-layer lead frame 57(Y), and respectively constitute two groups of parallel circuit with single-layer lead frame 57(Y). Wire 571(S) is in series connection with two groups of parallel circuit. Power pin 576 of individual single-layer lead frame 57 and electrode contact 573 are mutually separated in relative position of each single-layer lead frame 57 to connect with high and low potential electrode contacts of SMD LED 43. Each installation seat 572 jointly consists of installation seat wire 5721 of 2 pieces of single-layer lead frame 57, and has the same dimension as bearing disc 5722. During superposition, they can really be mutually pasted based in bearing disc 5722, and provide SMD LED 43 with stable installation environment based on the superimposed structural rigidity. Installation seat wire 5721 is connected with wire 571 in series connection. Each installation seat wire 5721 is equipped with more than one electrode contacts 573, enabling SMD LED 43 to be connected with the circuit in parallel connection, that is, both ends of each section of wire 571 are connected with power pin 576 and installation seat wire 5721. Complete the production of these three single-layer lead frames 57 on single-layer charge tape 59 according to the practice in FIG. 6(*c*), it includes overall dimension of electrode contact 573. Complete the production of these two single-layer lead frames 57 in the meantime in single-layer charge tape 59 according to the practice in FIG. 6(*b*), it includes overall dimension of electrode contact 573. Install installation seat bearing disc 5722 and this piece of single-layer charge tape on the jig, firmly press and paste. Installation seat wire 5721 of 3 pieces of single-layer lead frames 57 separated by insulating joint 575. Installation seat wire 5721 can be solidly fixed with bearing disc 5722 and form installation seat 572 where can be installed with SMD LED 43. Installation seat wire 5721 form one group of high and low potential electrode contacts 573 in bearing disc 5722. Conductive adhesive is dripped on each electrode contact 573 of charge tape via glue dispersion machine. Install monochromatic SMD LED 43 on electrode contact 573 of each installation seat 572, conduct heating and solid jointing to enable SMD LED 43 to be broken over and steadily connected. Then power pin 576 of charge tape can be processed into form with the required shape and flexing angle, in the meantime, cut off and take out LED lead frame with power pins 576 on both end.

Embodiment 6 illustrates annular lead frame that is installed on top annular surface of fixed ring. Series and parallel annular lead frames of coplanar electrode monochromatic bare chip LED 41 are packaged on lead frame, and bare chip LED can be added with fluorescent powder to get white light as well.

Please refer to FIG. 8(*a*) and FIG. 8(*e*), structure diagram of series annular lead frame 531 of coplanar electrode monochromatic or white light bare chip LED 41 used in the present invention. Top annular surface 861 of main fixed ring body 81 can be installed with annular lead frame 531. Top annular surface 861 is also equipped with faying surface 8611 to paste the bottom of bearing disc 5722 of installation seat 572. The fastener's fixed surface 8612 of top annular surface 861 is used to fix wire fastener 91. The manufacturing method of annular lead frame 531 is first bend LED lead frame into form, fix power pins 576 on two ends with fastener 91 to get one annular lead frame 531, after pasting the bottom of bearing disc 5722 of installation seat 572 on main fixed ring body 81, use transparent materials to complete transparent package 85.

Please refer to FIG. 8(*b*) and FIG. 8(*e*), structure diagram of series lead frame of coplanar electrode monochromatic or white light bare chip LED 41 used in the present invention. LED lead frame of coplanar electrode monochromatic bare chip LED contains one piece of single-layer lead frame 57, more than one bearing discs 5722 and plural bare chip LEDs 41. Single-layer lead frame 57 has plural wire 571, insulating layer 570 (as per FIG. 8(*a*)), more than one installation seats 572 and two power pins 576. Installation seat 572 consists of two installation seat wires 5721 isolated by insulating joint 575. Installation seat wire 5721 has one group of electrode contacts 573 that can form high and low potential, which has the same dimension as bearing disc 5722. This single-layer lead frame is serial lead frame, it can be really mutually pasted to provide coplanar electrode monochromatic bare chip LED 41 with stable installation environment based on the superimposed structural rigidity. Coplanar electrode monochromatic bare chip LED 41 can be installed in bearing disc 5722 and connected to high and low potential electrode contacts with gold wire into series circuit. Both ends of each section of wire 571 are connected with power pin 576 and installation seat wire 5721. The production of charge tape 59 of this single-layer lead frame 57 can be completed according to the practice in FIG. 6(*b*), it includes overall dimension of electrode contact 573 and flexing. Install installation seat bearing disc 5722 and charge tape of this piece of single-layer lead frame 57 on the jig, solidly press and paste. installation seat wires 5721 separated by insulating joint 575 can be firmly fixed with bearing disc 5722, and form one group of high and low potential electrode contacts 573 in bearing disc 5722, and the installation space for coplanar electrode monochromatic bare chip LED 41 is available. Then fix the charge tape on chip pasting machine and fix coplanar electrode monochromatic bare chip LED 41 in the middle of bearing disc 5722 via chip pasting machine. Gold wire 44 can be pasted to electrode contact of coplanar electrode monochromatic bare chip LED 41 and electrode contact 573 of installation seat 572 with wire bonding machine. Transparent package cement 45 is dripped in the middle of bearing disc 5722 with glue dispersion machine until coplanar electrode monochromatic bare LED chip and gold wire 44 are fully covered. Through heating and hardening procedures, power pin 576 of charge tape can have the required shape and flexing angle. Cut off and take out LED lead frame with power pins 576.

Please refer to FIG. 8(*c*) and FIG. 8(*e*), structure diagram of parallel annular lead frame of coplanar electrode monochromatic bare chip LED 41 used in the present invention. Top annular surface 861 of main fixed ring body 81 can be installed with annular lead frame 532. Top annular surface 861 is equipped with faying surface 8611 to paste the bottom of bearing disc 5722 of installation seat 572. The fastener's fixed surface 8612 of top annular surface 861 is used to fix wire fastener 91. The manufacturing method of annular lead frame 532 is bend LED lead frame into form, fix power pins 576 on two ends with fastener 91 to get one annular lead frame 532, after fixing on main fixed ring body 81, use transparent materials to complete transparent package 85.

Please refer to FIG. 8(*d*) and FIG. 8(*e*), structure diagram of parallel LED lead frame of coplanar electrode monochromatic bare chip LED 41 used in the present invention. LED lead frame of coplanar electrode monochromatic bare chip LED 41 contains two parallel single-layer lead frames 57 isolated by insulating joint 575, plural installation seat bearing discs 5722 and plural bare chip LEDs 41 chip. Single-layer lead frame belongs to continuous lead frame. Two pieces of abreast single-layer lead frames 57 include one high potential and one low potential. Both single-layer lead frames 57 have plural wire 571, insulating layer 570 (as per FIG. 8(*c*)), more than one installation seats 572 and one power pin 576. Each installation seat 572 is jointly consisted of installation seat wires 5721 of 2 pieces of single-layer lead frame 57 isolated by insulating joint 575, which has the same dimension as bearing disc 5722. Installation seat wire 5721 is connected with wire 571 in series connection, and each installation seat wire 5721 is equipped with one electrode contact 573 to enable bare chip LED 41 to be connected with the circuit in parallel connection. Both ends of each section of wire 571 are connected with power pin 576 and installation seat wire 5721. Power pin 576 and electrode contact 573 of two lead frames 57 are mutually separated in relative position of each single-layer lead frame 57.

During superposition, they can be really mutually pasted on the basis of bearing disc 5722 to really provide stable installation environment for bare chip LED 41. The production of these two parallel single-layer lead frames 57 can be completed on the same piece of single-layer charge tape 59 as shown in FIG. 6(*b*), it includes overall dimension of electrode contact 573 and flexing. Install installation seat bearing disc 5722 and charge tapes of these two parallel single-layer lead frames 57 on the jig, solidly press and paste. installation seat wires 5721 being separated by insulating joint 575, firmly fixed with bearing disc 5722, and form one group of high and low potential electrode contacts 573 in bearing disc 5722. The installation space for coplanar electrode monochromatic bare chip LED 41 is available. Then fix the charge tape on chip pasting machine and fix bare chip LED 41 in the middle of bearing disc 5722 via chip pasting machine. Gold wire 44 can be pasted to electrode contact of coplanar electrode monochromatic bare chip LED 41 and electrode contact 573 of installation seat 572 with wire bonding machine. Transparent package cement 45 is dripped in the middle of bearing disc 5722 with glue dispersion machine until bare LED chip and gold wire 44 are fully covered. Through heating and hardening procedures, power pin 576 of charge tape have the required shape and flexing angle, in the meantime, cut off and take out LED lead frame with power pins 576 on both ends.

Please refer to FIG. 8(*e*), package section drawing of coplanar electrode monochromatic bare chip LED 41 is used in the present invention. When need white light, use blue light LED chip to stimulate yellow fluorescent powder. The figure respectively shows package profile of series and parallel bare chip LEDs 41 on installation seat 572. Two installation seat wires 5721 isolated by insulating joint 575 and flange face 5723 of bearing disc 5722 are pasted and fixed via insulating layer 570 to accomplish electric insulation. Electrode contact 573 is pasted in bearing disc 5722, and form one group of high and low potential electrode contacts 573 in bearing disc 5722. Coplanar electrode monochromatic bare chip LED 41 is fixed in the middle of bearing disc 5722 via chip pasting machine, and pasted on electrode contact of coplanar electrode monochromatic bare LED chip and electrode contact 573 with gold wire 44. Glue dispersion machine respectively drip transparent package cement 45 and yellow fluorescent powder 46 in the middle of bearing disc 5722 until bare chip LED 41 and gold wire 44 are fully filled. Through heating and hardening procedures, the package of bare chip LED 41 will be completed.

Embodiment 7 illustrates annular lead frame that is installed on top annular surface of fixed ring. Series and parallel annular lead frames of monochromatic bare chip LED 42 of upper and lower electrodes shall be packaged on the lead frame.

Please refer to FIG. 9(*a*), structure diagram of series annular lead frame 541 of monochromatic bare chip LED 42 of upper and lower electrodes is used in the present invention. Top annular surface 861 of main fixed ring body 81 can be installed with annular lead frame 541. Top annular surface 861 is also equipped with faying surface 8611 to paste on the bottom of bearing disc 5722 of installation seat 572 of LED lead frame (as per FIG. 9(*b*)). The fastener's fixed surface 8612 of top annular surface 861 is used to fix wire fastener 91. The manufacturing method of annular lead frame 541 is bend LED lead frame into form, fix power pins 576 on two ends with fastener 91 to get one annular lead frame 541, after fixing on main fixed ring body 81, use transparent materials to complete transparent package 85.

Please refer to FIG. 9(*b*), layered structure diagram of series LED lead frame of monochromatic bare chip LED 42 of upper and lower electrodes is used in the present invention. LED lead frame of monochromatic bare chip LED 42 contains one piece of single-layer lead frame 57, plural installation seat bearing discs 5722 and plural bare chip LEDs 42. Single-layer lead frame 57 has plural wire 571, insulating layer 570 (as per FIG. 9(*a*)), more than one installation seats 572 and two power pins 576. Installation seat 572 consists of two installation seat wires 5721 isolated by insulating joint 575, which has one electrode contact 573 that can form high and low potential. Single-layer lead frames 57 is serial lead frame, enabling monochromatic bare chip LED 42 of upper and lower electrodes to be connected with circuit in series connection during installation. Single-layer lead frame 57 is serial lead frame, that is, both ends of each section of wire 571 are connected with power pin 576 and installation seat wire 5721. During superposition, installation seat wire 5721 and bearing disc 5722 of single-layer lead frame 57 located in the same dimension, so they can be mutually pasted to provide monochromatic bare chip LED 42 of upper and lower electrodes with stable installation environment based on superimposed structural rigidity. Electrode contact 573 is also pasted in bearing disc 5722. The production of charge tape 59 of single-layer lead frame 57 can be completed according to the practice in FIG. 6(*b*), it includes overall dimension of electrode contact 573 and flexing. Installation seat bearing disc 5722 and charge tape of this piece of single-layer lead frame 57 on the jig by solidly pressing and pasting. installation seat wires 5721 separated by insulating joint 575 can be firmly fixed with bearing disc 5722, form installation seat 572 where can be installed with SMD LED 43, and form one group of high and low potential electrode contacts 573 in bearing disc 5722. Fix charge tape on chip pasting machine. Fix monochromatic bare chip LED 42 of upper and lower electrodes on one electrode contact 573 of each installation seat via chip pasting machine to enable the lower electrode contact of bare chip LED 42 to be connected. gold wire 44 can be pasted on upper electrode contact of monochromatic bare chip LED 42 of upper and lower electrodes and another electrode contact 573 on installation seat 572 with wire bonding machine. Glue dispersion machine will drip transparent package cement 45 (as per FIG. 8(*e*)) and fluorescent powder 46 (as per FIG. 8(*e*)) in the middle of bearing disc 5722 until bare LED chip and gold wire 44 are fully filled. Through heating and hardening procedures, power pin 576 of charge tape can have the required shape and flexing angle. Cut off and take out LED lead frame with power pins 576 on both ends.

Please refer to FIG. 9(*c*), structure diagram of parallel annular lead frame of monochromatic bare chip LED of upper and lower electrodes is used in the present invention. Top annular surface 861 of main fixed ring body 81 can be installed with annular lead frame 542. top annular surface 861 is also equipped with faying surface 8611 to paste the bottom of bearing disc 5722 of installation seat 572 of LED lead frame (as per FIG. 9(*d*)). The fastener's fixed surface 8612 of top annular surface 861 is used to fix wire fastener 91. The manufacturing method of annular lead frame 542 is bend LED lead frame into form, fix power pins 576 on two ends with fastener 91 to get one annular lead frame 542, after fixing on main fixed ring body 81, use transparent materials to complete transparent package 85.

Please refer to FIG. 9(*d*), layered structure diagram of parallel LED lead frame of monochromatic bare chip LED 42 of upper and lower electrodes is used in the present invention. LED lead frame of monochromatic bare chip LED 42 of upper and lower electrodes contains 2 pieces of single-layer lead frame 57, plural installation seat bearing discs 5722 and plural bare chip LEDs 42. Each single-layer lead frame 57 has plural wire 571, insulating layer 570 (as per FIG. 9(*c*)), more than one installation seats 572 and one power pin 576. Installation seat 572 consists of two installation seat wires 5721 without insulating joint 575 (as per FIG. 9(*a*)) and isolated by insulating layer 570, which has one electrode contact 573 that can form high and low potential. Two pieces of single-layer lead frames 57 are continuous lead frames, enabling bare chip LED 42 to be connected with circuit in parallel connection during installation. Each section of wire 571 is connected with power pin 576 and installation seat wire 5721. During superposition, installation seat wire 5721 and bearing disc 5722 of two single-layer lead frames 57 located in the same dimension, so they can be mutually pasted to provide monochromatic bare chip LED 42 of upper and lower electrodes with stable installation environment based on superimposed structural rigidity. Electrode contact 573 is also pasted in bearing disc 5722. The production of charge tape 59 of single-layer lead frame 57 can be completed according to the practice in FIG. 6(*b*), it includes overall dimension of electrode contact 573 and flexing. Installation seat bearing disc 5722 and charge tapes of these two pieces of single-layer lead frames 57 are fixed on the jig by solidly pressing and pasting, and form one group of high and low potential electrode contacts 573 in bearing disc 5722. installation seat wire 5721 can be firmly fixed with bearing disc 5722, then fix charge tape on chip pasting machine, and fix monochromatic bare chip LED 42 of upper and lower electrodes on one electrode contact 573 of each installation seat via chip pasting machine to enable the lower electrode contact of bare chip LED 42 to be connected. Gold wire 44 can be pasted on upper electrode contact of bare chip LED 42 and another electrode contact 573 on installation seat 572 with wire bonding machine. Glue dispersion machine will drip transparent package cement 45 (as per FIG. 8(*e*)) in the middle of bearing disc 5722 until monochromatic bare LED chip and gold wire 44 of upper and lower electrodes are fully filled. Through heating and hardening procedures, power pin 576 of charge tape can be processed into the required shape and flexing angle. In the meantime, cut off and take out LED lead frame with power pins 576 on both ends.

Embodiment 8 illustrates annular lead frame that is installed on top annular surface of fixed ring. Series and parallel annular lead frames of coplanar electrode multicolor bare chip LED 41 shall be packaged on lead frame.

Please refer to FIG. 10(*a*) and FIG. 10(*e*), structure diagram of series annular lead frame 551 of coplanar electrode multicolor bare chip 41 is used in the present invention. Top annular surface 861 of main fixed ring body 81 can be installed with annular lead frame 551. Top annular surface 861 is also equipped with faying surface 8611 to paste the bottom of bearing disc 5722 of installation seat 572 of LED lead frame, and the fastener's fixed surface 8612 of top annular surface 861 is used to fix wire fastener 91. The manufacturing method of annular lead frame 551 is first bend LED lead frame into form, fix power pins 576 on two ends with fastener 91 to get one annular lead frame 551, after fixing on main fixed ring body 81, use transparent materials to complete transparent package 85.

Please refer to FIG. 10(*b*) and FIG. 10(*e*), layered structure diagram of series LED lead frame of coplanar electrode multicolor bare chip LED 41 is used in the present invention. LED lead frame of coplanar electrode multicolor bare chip LED 41 contains red single-layer lead frame 57(R), green single-layer lead frame 57(G), blue single-layer lead frame 57(B), plural bearing discs 5722 and plural multicolor bare chip LEDs 41. RGB single-layer lead frame 57 has plural wire 571, insulating layer 570, more than one installation seats 572, two high and low potential power pins 576, or one high potential power pin 576 and one low potential common contact 574. In which low potential power pin 576 and low potential common contact 574 are located on the same end of lead frame; high potential power pin 576 is located on the other end of the lead frame. Installation seat 572 of the same piece of single-layer lead frame 57 consists of two installation seat wires 5721 isolated by insulating joint 575. Each single-layer lead frame 57 is serial lead frame. Installation seat wire 5721 and bearing disc 5722 located in the same dimension and electrode contact 573 that can form high and low potential in series connection. Both ends of each section of wire 571 are connected with installation seat wire 5721 in addition to power pin 576 or common contact 574. During superposition, electrode contact 573 and insulating joint 575 of installation seat 572 of each single-layer lead frame 57 are mutually staggered. Wire 571 and installation seat wire 5721 of each single-layer lead frame 57 respectively located in the same dimension. During superposition, they can be mutually pasted and mutually insulated to form internal space for installation seat 572, so they can mutually pasted to provide coplanar electrode multicolor bare chip LED 41 with stable installation environment based on superimposed structural rigidity. Electrode contact 573 is also pasted in bearing disc 5722, and coplanar electrode color LED 41 can be installed on bearing disc 5722 and gold wire can be used to make series connection of high and low potential electrode contacts into series circuit. The production of charge tape of this single-layer lead frame 57 can be completed according to the practice in FIG. 6(*b*), it includes overall dimension of electrode contact 573 and flexing. Install installation seat bearing disc 5722 and charge tapes of these three pieces of single-layer lead frames 57 are fixed on the jig by solidly pressing and pasting. The superimposed and mutually staggered installation seat wires 5721 separated by insulating joint 575 can be firmly fixed with bearing disc 5722, and form installation space for coplanar electrode multicolor bare chip LED 41 in the middle of bearing disc 5722. Fix the solid charge tape on chip pasting machine and paste coplanar electrode multicolor bare chip LED 41 in the middle of bearing disc 5722. Gold wire 44 can be pasted on electrode contact of bare chip LED 41 and relative electrode contact 573 on installation seat wire 5721 with wire bonding machine and changed into individually independent series circuit. Inject conductive adhesive on common contact 574 to enable low potential common contact 574 of series circuit to be connected with low potential power pin 576. Glue dispersion machine will drip transparent package cement 45 in the middle of bearing disc 5722 until bare LED chip and gold wire 44 are fully filled. Through heating and hardening procedures, power pin 576 of charge tape can be processed into the required shape and flexing angle. Cut off and take out LED lead frame with power pins 576 on both ends.

Please refer to FIG. 10(*c*) and FIG. 10(*f*), structure diagram of parallel annular lead frame 552 of coplanar electrode multicolor bare chip LED 41 in the present invention. Top annular surface 861 of main fixed ring body 81 can be installed with annular lead frame 552. Top annular surface 861 is also equipped with faying surface 8611 to paste the bottom of bearing disc 5722 of installation seat 572 of LED lead frame. The fastener's fixed surface 8612 of top annular surface 861 is used to fix wire fastener 91. The manufacturing method of annular lead frame 552 is bend LED lead frame into form, fix power pins 576 on two ends with fastener 91 to get one annular lead frame 552, after fixing on main fixed ring body 81, use transparent materials to complete transparent package 85.

Please refer to FIG. 10(*d*) and FIG. 10(*f*), layered structure diagram of parallel LED lead frame of coplanar electrode multicolor bare chip LED 41 used in the present invention. LED lead frame of coplanar electrode multicolor bare chip LED 41 contains red single-layer lead frame 57(R), green single-layer lead frame 57(G), blue single-layer lead frame 57(B) and 57(C) common ground single-layer lead frame 57(C), plural bearing discs 5722 and plural coplanar electrode multicolor bare chip LEDs 41. Any layer of RGB lead frame 5 has plural wire 571, insulating layer 570, more than one installation seats 572 and one high potential power pin 576. Common ground lead frame 57 has plural wire 571, insulating layer 570, more than one installation seats 572 and one low potential power pin 576. High potential power pin 576 and low potential power pin 576 are respectively located on different both ends. Installation seat 572 consists of installation seat wires 5721 without insulating joint 575 and isolated by insulating layer 570. Each single-layer lead frame 57 is continuous lead frame. Installation seat wire 5721 of RGB single-layer lead frame 57 has parallel electrode contact 573 that can form high potential and the same dimension as bearing disc 5722. Installation seat wire 5721 of common ground lead frame 57 has parallel common ground electrode contact 573 that can form low potential and the same dimension as bearing disc 5722, so they can be mutually pasted to provide monochromatic bare chip LED 41 with stable installation environment based on superimposed structural rigidity. Electrode contact 573 is also pasted in bearing disc 5722. Gold wire can be used to make series connection of high and low potential electrode contacts into parallel circuit. Both ends of RGB single-layer lead frame 57 of each section of wire 571 are connected with installation seat wire 5721 in addition to high potential power pin 576. The production of charge tapes 59 of this single-layer lead frame 57 is completed according to the practice in FIG. 6(*b*). It includes overall dimension of electrode contact 573 and flexing. Install installation seat bearing disc 5722 and charge tapes of these four RGBC single-layer lead frames 57 on the jig, and solidly press and paste. The installation seat wires 5721 separated by insulating layer 570 can be firmly fixed with bearing disc 5722, and form installation space for coplanar electrode multicolor bare chip LED 41 in the middle of bearing disc 5722. Fix the solid charge tape on chip pasting machine and paste coplanar electrode multicolor bare chip LED 41 in the middle of bearing disc 5722. Gold wire 44 can be pasted on electrode contact of bare chip LED 41, high potential electrode contact 573 on installation seat wire 5721 and low potential common ground electrode contact 573 with wire bonding machine and changed into individually independent parallel circuit, as shown in FIG. 10(*c*). Then glue dispersion machine will drip transparent package cement 45 in the middle of bearing disc 5722 until coplanar electrode multicolor bare chip LED 41 and gold wire 44 are fully filled. Through heating and hardening procedures, power pin 576 of charge tape can be processed into the required shape and flexing angle, in the meantime, cut off and take out LED lead frame with power pins 576 on both ends.

Please refer to FIG. 10(*e*), package section drawing of coplanar electrode multicolor bare chip LED 41 used in the present invention. The figure illustrates package profile of series bare chip LED 41 on installation seat 572. Installation seat wire 5721 of RGB single-layer lead frame 57 and flange face 5723 of bearing disc 5722 are pasted and fixed via insulating layer 570 to accomplish electric insulation. Electrode contact 573 is also pasted in bearing disc 5722. Coplanar electrode monochromatic bare chip LED 41 is fixed in the middle of bearing disc 5722 via chip pasting machine. The figure only shows green LED chip, which is pasted on electrode contact of green (G) bare LED chip and electrode contact 573 of green single-layer lead frame 57(G) with gold wire 44. Glue dispersion machine will drip transparent package cement 45 and yellow fluorescent powder 46 in the middle of bearing disc 5722 until bare chip LED 41 and gold wire 44 are fully filled. Through heating and hardening procedures, the package of bare chip LED 41 will be completed.

Please refer to FIG. 10(*f*), package section drawing of coplanar electrode multicolor bare chip LED 41 used in the present invention. The figure illustrates package profile of parallel bare chip LED 41 on installation seat 572. Installation seat wire 5721 of RGBC single-layer lead frame 57 and flange face 5723 of bearing disc 5722 are pasted and fixed via insulating layer 570 to accomplish electric insulation. Electrode contact 573 is also pasted in bearing disc 5722. Coplanar electrode monochromatic bare chip LED 41 is fixed in the middle of bearing disc 5722 via chip pasting machine. The figure only shows green LED chip, which is pasted on electrode contact of green (G) bare LED chip, electrode contact 573 of green single-layer lead frame 57(G) with gold wire 44 and electrode contact 573 of common ground single-layer lead frame 57(C). Glue dispersion machine will drip transparent package cement 45 in the middle of bearing disc 5722 until bare chip LED 41 and gold wire 44 are fully filled. Through heating and hardening procedures, the package of bare chip LED 41 will be completed.

Embodiment 9 illustrates annular lead frame that is installed on top annular surface of fixed ring. Series and parallel annular lead frames of multicolor bare chip LED 42 of upper and lower electrodes shall be packaged on lead frame.

Please refer to FIG. 11(*a*) and FIG. 11(*f*), structure diagram of parallel annular lead frame 561 of multicolor bare chip LED 42 of upper and lower electrodes in the present invention. Top annular surface 861 of main fixed ring body 81 can be installed with annular lead frame 561. Top annular surface 861 is also equipped with faying surface 8611 to paste the bottom of bearing disc 5722 of installation seat 572 of LED lead frame. The fastener's fixed surface 8612 of top annular surface 861 is used to fix wire fastener 91. The manufacturing method of annular lead frame 561 is bend LED lead frame into form, fix power pins 576 on two ends with fastener 91 to get one annular lead frame 561, after fixing on main fixed ring body 81, use transparent materials to complete transparent package 85.

Please refer to FIG. 11(*b*) and FIG. 11(*f*), layered structure diagram of parallel LED lead frame of multicolor bare chip LED 42 of upper and lower electrodes used in the present invention. LED lead frame of multicolor bare chip LED 42 of upper and lower electrodes contains red single-layer lead frame 57(R), green single-layer lead frame 57(G), blue single-layer lead frame 57(B), (C) common ground single-layer lead frame 57(C), plural bearing discs 5722 and plural multicolor bare chip LEDs 42. Any layer of RGB lead frame has plural wire 571, insulating layer 570, more than one installation seats 572 and one high potential power pin 576. Common ground lead frame 57 has plural wire 571, insulating layer 570, more than one installation seats 572 and one low potential power pin 576. In which high potential power pin 576 and low potential power pin 576 are respectively located on different both ends. Installation seat 572 consists of installation seat wires 5721 without insulating joint 575 and isolated by insulating layer 570. Each single-layer lead frame 57 is continuous lead frame. Installation seat wire 5721 of RGB single-layer lead frame 57 has parallel electrode contact 573 that can form high potential and the same dimension as bearing disc 5722. Installation seat wire 5721 of common ground lead frame 57 has parallel common ground electrode contact 573 that can form low potential and the same dimension as bearing disc 5722, so they can be mutually pasted to provide monochromatic bare chip LED 42 with stable installation environment based on superimposed structural rigidity. Electrode contact 573 is also pasted in bearing disc 5722, and multicolor bare chip LED 42 of upper and lower electrodes can be installed on low potential common ground electrode contact 573 and gold wire can be used to make parallel connection of high potential electrode contacts into parallel circuit, as shown in FIG. 11(*a*). both ends of each section of wire 571 of 57(RGB) single-layer lead frame 57 are connected with installation seat wire 5721 in addition to high potential power pin 576, both ends of 57(C) common ground lead frame of each section of wire 571 are connected with installation seat wire 5721 in addition to low potential power pin 576. The production of charge tapes 59 of these single-layer lead frames 57 can be completed according to the practice in FIG. 6(*b*), it includes overall dimension of electrode contact 573 and flexing. Install installation seat bearing disc 5722 and charge tapes of these four RGBC single-layer lead frames 57 are fixed on the jig by solidly pressing and pasting. The installation seat wires 5721 separated by insulating layer 570 can be firmly fixed with bearing disc 5722, and form installation space for multicolor bare chip LED 42 of upper and lower electrodes on low potential common ground electrode contact 573 in bearing disc 5722. Fix the solid charge tape on chip pasting machine and paste the electrode contact on the bottom of multicolor bare chip LED 42 of upper and lower electrodes with conductive adhesive on low potential common ground electrode contact 573 in bearing disc 5722. Gold wire 44 can be pasted on electrode contact of bare chip LED 42 and relative high potential electrode contact 573 on installation seat wire 5721 with wire bonding machine and changed into individually independent parallel circuit, as shown in FIG. 11(*a*). Then glue dispersion machine will drip transparent package cement 45 in the middle of bearing disc 5722 until bare LED chip and gold wire 44 are fully filled. Through heating and hardening procedures, power pin 576 of charge tape can be processed into the required shape and flexing angle, in the meantime, cut off and take out LED lead frame with power pins 576 on both ends.

Please refer to FIG. 11(*c*) and FIG. 11(*e*), structure diagram of series annular lead frame 562 of multicolor bare chip 42 of upper and lower electrodes in the present invention. Top annular surface 861 of main fixed ring body 81 can be installed with annular lead frame 562. Top annular surface 861 is also equipped with faying surface 8611 to paste the bottom of bearing disc 5722 of installation seat 572 of LED lead frame. The fastener's fixed surface 8612 of top annular surface 861 is used to fix wire fastener 91. The manufacturing method of annular lead frame 551 is bend LED lead frame into form, fix power pins 576 on two ends with fastener 91 to get one annular lead frame 551, after fixing on main fixed ring body 81, use transparent materials to complete transparent package 85.

Please refer to FIG. 11(*d*) and FIG. 11(*e*), layered structure diagram of series LED lead frame of multicolor bare chip LED 42 of upper and lower electrodes used in the present invention. LED lead frame of multicolor bare chip LED 42 of upper and lower electrodes contains red single-layer lead frame 57(R), green single-layer lead frame 57(G), blue single-layer lead frame 57(B), plural bearing discs 5722 and plural multicolor bare chip LEDs 42. RGB single-layer lead frame 57 has plural wire 571, insulating layer 570, more than one installation seats 572, two high and low potential power pins 576, or one high potential power pin 576 and one low potential common contact 574. Low potential power pin 576 and low potential common contact 574 are located on the same end of lead frame, and high potential power pin 576 is located on the other end of lead frame. Installation seat 572 of the same piece of single-layer lead frame 57 consists of two installation seat wires 5721 isolated by insulating joint 575. Each single-layer lead frame 57 is serial lead frame. Installation seat wire 5721 and bearing disc 5722 have the same dimension and series electrode contact 573 that can form high and low potential. Both ends of each section of wire 571 are connected with installation seat wire 5721 in addition to power pin 576 or common contact 574. During superposition, electrode contact 573 and insulating joint 575 of installation seat 572 of each single-layer lead frame 57 are mutually staggered. Wire 571 and installation seat wire 5721 of each single-layer lead frame 57 respectively located in the same dimension. During superposition, they can be pasted and mutually insulated and form internal space for installation seat 572, so they can really mutually be pasted to provide multicolor bare chip LED 42 with stable installation environment based on superimposed structural rigidity. In the meantime, electrode contact 573 is also pasted in bearing disc 5722. Multicolor bare chip LED 42 of upper and lower electrodes can be installed on low potential electrode contact 573 on bearing disc 5722. Gold wire can be used to make series connection of high and low potential electrode contacts into series circuit. The production of charge tape 59 of each single-layer lead frame 57 can be completed according to the practice in FIG. 6(*b*), it includes overall dimension of electrode contact 573 and flexing. Install installation seat bearing disc 5722 and charge tapes of these three pieces of single-layer lead frames 57 are fixed on the jig by solidly pressing and pasting. The superimposed and mutually staggered installation seat wires 5721 separated by insulating joint 575 can be firmly fixed with bearing disc 5722, and form installation space for multicolor bare chip LED 42 in low potential electrode contact 573 of bearing disc 5722. Fix the solid charge tape on chip pasting machine and paste electrode contact on the bottom of multicolor bare chip LED 42 with conductive adhesive on low potential electrode contact 573 of bearing disc 5722. Gold wire 44 can be pasted on electrode contact of bare chip LED 42 and relatively high potential electrode contact 573 on installation seat wire 5721 with wire bonding machine and changed into individual independent series circuit. Inject conductive adhesive on common contact 574 to enable low potential common contact 574 of series circuit to be connected with low potential power pin 576. Glue dispersion machine will drip transparent package cement 45 in the middle of bearing disc 5722 until bare LED chip and gold wire 44 are fully filled. Through heating and hardening procedures, power pin 576 of charge tape can be processed into the required shape and flexing angle. Cut off and take out LED lead frame with power pins 576 on both ends.

Please refer to FIG. 11(*e*), package section drawing of multicolor bare chip LED 42 of upper and lower electrodes used in the present invention. The figure illustrates package profile of multicolor bare chip LED 42 of upper and lower electrodes on installation seat 572. Installation seat wire 5721 of RGB single-layer lead frame 57 and flange face 5723 of bearing disc 5722 are pasted and fixed via insulating layer 570 to accomplish electric insulation. Electrode contact 573 is also pasted in bearing disc 5722. The multicolor bare chip LEDs 42 of upper and lower electrodes are fixed on low potential electrode contact 573 via chip pasting machine. The figure only shows green LED chip, which is pasted on electrode contact of green (G) bare LED chip and high potential electrode contact 573 of green single-layer lead frame 57(G). Glue dispersion machine will drip transparent package cement 45 in the middle of bearing disc 5722 until bare chip LED 42 and gold wire 44 are fully filled. Through heating and hardening procedures, the package of bare chip LED 42 will be completed.

Please refer to FIG. 11(*f*), package section drawing of multicolor bare chip LED 42 of upper and lower electrodes used in the present invention. The figure illustrates package profile of multicolor bare chip LED 42 of upper and lower electrodes on installation seat 572. Installation seat wire 5721 of RGB single-layer lead frame 57 and flange face 5723 of bearing disc 5722 are pasted and fixed via insulating layer 570 to accomplish electric insulation. Electrode contact 573 is also pasted in bearing disc 5722. The multicolor bare chip LEDs 42 of upper and lower electrodes are fixed on low potential electrode contact 573 of 57(C) common ground lead frame via chip pasting machine. The figure only shows green LED chip, which is pasted on electrode contact of green (G) bare LED chip and high potential electrode contact 573 of green single-layer lead frame 57(G). Glue dispersion machine will drip transparent package cement 45 in the middle of bearing disc 5722 until bare chip LED 41 and gold wire 44 are fully filled. Through heating and hardening procedures, the package of bare chip LED 41 will be completed.

What is claimed is:

1. An integrated illumination part and a lead frame of an umbrella, wherein the integrated illumination part made of a fixed ring assembly, there is a central hole for a shaft made of fixed ring assembly has shaft passing through, which is fixed on the shaft with a pin, the structure contains a main fixed ring body, an annular lead frame and a transparent package, characterized in that the features are:

said integrated illumination part comprises a LED chip group, a fastener, a faying surface, a fastener's fixed surface, a wire fastener, a LED lead frame, a bearing disc, and a main movable collar body;

said annular lead frame comprises an installation seat, a plurality of power pins;

exterior annular surface of main fixed ring body contains a top annular surface, a middle annular surface and a bottom annular surface;

said bottom annular surface being equipped with a plurality of heat dissipating fins;

the bottom annular surface being used as heat dissipating surface of said LED chip group;

said top annular surface being installed with said annular lead frame;

said top annular surface being equipped with said faying surface and said fastener's fixed surface;

said faying surface is used to fit the underside of said installation seat;

said fastener's fixed surface is used to fix said wire fastener;

said annular lead frame being made of conductive metal;

said power pins on both ends of said annular lead frame being fixed with said fastener to get one annular lead frame;

said LED lead frame comprises a plurality of wires, more than one installation seats;

each end of said installation seats connect with said wire and one power pin;

the underside of said installation seat of annular lead frame being installed and pasted on said faying surface;

said power pin being input with proper power according to the demand of LED chip group;

said annular lead frame being fixed on said main movable collar body; and said transparent package uses transparent materials to package top annular surface into one integrated illumination part.

2. The integrated illumination part and the lead frame of umbrella as claimed in claim 1, said umbrella applies said fixed ring assembly;

said umbrella comprises a flexible canopy, a shaft, a plate spring, a pressing switch, a handle, a top column, a rib members, a linkages, a slip ring, a fixed collar, a power socket, a plurality of electrical wires, a battery, a pivot;

said shaft being installed with said plate spring;

said electrical wires being located in the hollow part of said shaft;

top end of said shaft being equipped with said top column;

lower part of said shaft being equipped with said handle;

upper part of said shaft being equipped with said pressing switch;

said battery located inside said shaft;

the upper part of said shaft being installed with said slip ring assembly and said power socket;

said rib members and said linkages being mutually connected with said pivot;

said rib members and said linkages being respectively fixed on said fixed collar and said slip ring assembly with said pivot;

said flexible canopy being fixed on said rib members;

the middle of said flexible canopy has a through hole;

said shaft being pass through said top annular surface of fixed collar, clamped and fixed by the lower border of said top column;

said slip ring assembly being sliding upward and downward along said shaft;

said shaft is equipped with said through hole; and said electrical wires pass through said through hole and connect said power socket.

3. The integrated illumination part and the lead frame of umbrella as claimed in claim 2, said power socket let power pin maintain insulated and dry to avoid from circuit short circuit; and proper voltage being input via said power pin according to the demand of said LED chip group.

4. The integrated illumination part and the lead frame of umbrella as claimed in claim 1, said handle, said top column, said fixed collar, being used to produce said integrated illumination part; and appearance of said transparent package being projected on the light type of said flexible canopy according to the demand and produced into focusing curved surfaces.

5. The integrated illumination part and the lead frame of umbrella as claimed in claim 1, the vertical normal and shaft's center line of said installation seat faying surface of top annular surface of the main fixed ring body form a included angle; and said angle is from 90 degrees to 20 degrees.

6. The integrated illumination part and the lead frame of umbrella as claimed in claim 1, the quantity of said installation seat faying surfaces of top annular surface of the main fixed ring body is more than one; and said faying surface is plane.

7. The integrated illumination part and the lead frame of umbrella as claimed in claim 1, said faying surface being a curved surface;

the underside of said installation seat of annular lead frame is installed with said bearing disc according to the demand of said LED chip; and the bottom shape of said bearing disc fit the curved faying surface of top annular surface of main fixed ring body.

* * * * *